US011844373B2

(12) United States Patent
Polloni et al.

(10) Patent No.: US 11,844,373 B2
(45) Date of Patent: Dec. 19, 2023

(54) RIGID PACKAGE OF ARTICLES, IN PARTICULAR FROM SMOKE, SHAPED LIKE A ROD AND ITS METHOD OF REALIZATION

(71) Applicant: G.D SOCIETA' PER AZIONI, Bologna (IT)

(72) Inventors: Roberto Polloni, Bologna (IT); Luca Paradiso, Bologna (IT); Luca Lanzarini, Bologna (IT); Roberto Ghiotti, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 17/716,706

(22) Filed: Apr. 8, 2022

(65) Prior Publication Data

US 2023/0075912 A1 Mar. 9, 2023

(51) Int. Cl.

| | |
|---|---|
| ***B65D 85/10*** | (2006.01) |
| ***A24F 15/01*** | (2020.01) |
| ***A24F 15/20*** | (2006.01) |

(52) U.S. Cl.

CPC ..... *A24F 15/01* (2020.01); *A24F 15/20* (2013.01)

(58) Field of Classification Search

CPC ..... A24F 15/20; A24F 15/18; A24F 15/12; A24F 17/04; A24F 17/10; A24F 23/00;

(Continued)

(56) References Cited

U.S. PATENT DOCUMENTS 5,323,895 A * 6/1994 Sutherland ..... B65D 71/40 206/161
5,402,889 A * 4/1995 Hermann ..... B65D 5/4233 206/443

FOREIGN PATENT DOCUMENTS

BE 639781 A 5/1964
JP H1135081 A 2/1999

(Continued)

OTHER PUBLICATIONS

JPH1135081 English Translation provided by EPO, accessed date Apr. 8, 2023. (Year: 1997).*

(Continued)

*Primary Examiner* — King M Chu
(74) *Attorney, Agent, or Firm* — MARSHALL, GERSTEIN & BORUN LLP

(57) ABSTRACT

Rigid pack for rod-shaped articles includes; a parallelepiped-shaped container, which houses the group of articles and has at least a lower wall, a front wall, a rear wall and two side walls; and a support system arranged in the container and has at least a first containing wall, which is parallel to the lower wall and is provided with a plurality of through holes, each engaged by a corresponding smoking article. The support system consists of a first articulated parallelogram having a frame glued to the rear wall of the container, two cranks and a connecting rod, which only rests against the front wall of the container, so that, while the rigid pack is being manufactured, the support system can be formed with the first articulated parallelogram in a flat condition and can subsequently be expanded by opening the first articulated parallelogram by rotation of both cranks.

21 Claims, 31 Drawing Sheets

(58) Field of Classification Search
CPC ..... B65D 85/1072; B65D 85/12; B65D 85/1036; B65D 85/1063; B65D 85/1081; B65D 5/5495
USPC ..... 229/120.09, 120.18, 160.1, 120.17, 229/120.02, 120.24; 206/256, 273, 236
See application file for complete search history.

(56) References Cited

FOREIGN PATENT DOCUMENTS

| | | | |
|---|---|---|---|
| WO | WO-2007/091116 | A1 | 8/2007 |
| WO | WO-2017/013741 | A1 | 1/2017 |
| WO | WO-2017/013742 | A1 | 1/2017 |

OTHER PUBLICATIONS

Italian Search Report and Opinion for Italian Patent Application No. 102021000008867, dated Dec. 8, 2021.

* cited by examiner

RIGID PACKAGE OF ARTICLES, IN PARTICULAR FROM SMOKE, SHAPED LIKE A ROD AND ITS METHOD OF REALIZATION

CROSS-REFERENCE TO RELATED APPLICATIONS

This patent application claims priority from Italian patent application no. 102021000008867 filed on Apr. 9, 2021, the entire disclosure of which is incorporated herein by reference.

TECHNICAL SECTOR

The present invention relates to a rigid pack for rod-shaped articles, in particular smoking articles and a relative manufacturing method.

STATE OF THE PRIOR ART

Traditionally, a rigid packet of cigarettes comprises a group of cigarettes in direct contact with each other (and normally arranged on three layers consisting of seven, six and seven cigarettes, respectively), a wrapper which completely wraps the group of cigarettes, and a container that is provided with a hinged lid and houses the wrapper in its inside which envelops the group of cigarettes. In a traditional pack of this type, the extraction of the first cigarette is relatively easy (despite the fact that the cigarettes are in close contact with each other and also slightly pressed the ones against the others) because the cigarettes can be easily and widely elastically deformed and therefore it is possible to "create" space with the fingers in order to extract (pull out) the first cigarette from the group of cigarettes. However, a traditional pack of this type is not suitable for containing rigid (i.e. non-deformable) cartridges for new generation cigarettes (e.g. electronic cigarettes), because since the rigid cartridges cannot be elastically deformed (e.g. because they are enclosed in a cylinder casing made of plastic or metallic material), it becomes extremely difficult (if not impossible) to extract the first rigid cartridge without damage.

To overcome this drawback, rigid packs of rod-shaped smoking articles have been proposed, for example of the type described in patent applications WO2017013741A1 and WO2017013742A1; such a rigid pack of this type comprises a group of smoking articles, a container that is provided with a hinged lid and houses the group of smoking articles in its inside, and a support system that is arranged inside the container and defines a series of seats each adapted to contain a single smoking article while keeping the smoking article separate and at a certain distance from the adjacent smoking articles. This makes it easy to grasp each smoking article (as it is spaced apart from the adjacent smoking articles) in order to extract the smoking article from the pack. According to some embodiments, the support system comprises at least one wall that is arranged parallel to a back wall of the container, is arranged perpendicular to the smoking articles (i.e., to the longitudinal axis of the smoking articles), and has a plurality of through holes each of which is engaged by a corresponding smoking article in order to define a certain and predetermined position of the smoking article.

However, rigid packs of smoking articles of this type are complex (and therefore expensive) to produce as they require the presence of: a first bending unit for making, by bending a first blank, the support system and for coupling the group of smoking articles to the support system, a second bending unit for making, by bending a second blank, the container around the support system coupled to the group of smoking articles, and a transport unit for transferring the support system coupled to the group of smoking articles from the first bending unit to the second bending unit. In fact, these three units (which are distinct from each other and use two different blanks) form a particularly complex, costly and cumbersome packing system.

Patent application JPH1135081A describes a box for medicine bottles having a high containment to prevent the bottles from being damaged by hitting each other during transport.

Patent application WO2007091116A1 describes a blank for packing vials (or similar elongated articles) and comprising a plurality of adjacent blank sections that can be bent to provide a box having an inner support portion for housing and holding the vials in corresponding holding holes.

Patent application BE639781A describes a containing element for a rigid pack for rod-shaped articles.

OBJECT OF THE INVENTION

Aim of the present invention is to provide a rigid pack for rod-shaped articles, in particular smoking articles and a relative manufacturing method, which rigid pack is free of the disadvantages described above and is therefore easy and inexpensive to produce (i.e. requires a single simple and compact packer machine for its production).

In accordance with the present invention there are provided a rigid pack for rod-shaped articles, in particular smoking articles and a relative manufacturing method, as claimed in the appended claims.

The claims also form an integral part of this description.

BRIEF DESCRIPTION OF THE DRAWINGS

The present invention will now be described with reference to the accompanying drawings, showing some non-limiting embodiments thereof, wherein.

PREFERRED EMBODIMENT OF THE INVENTION

Figure 1:
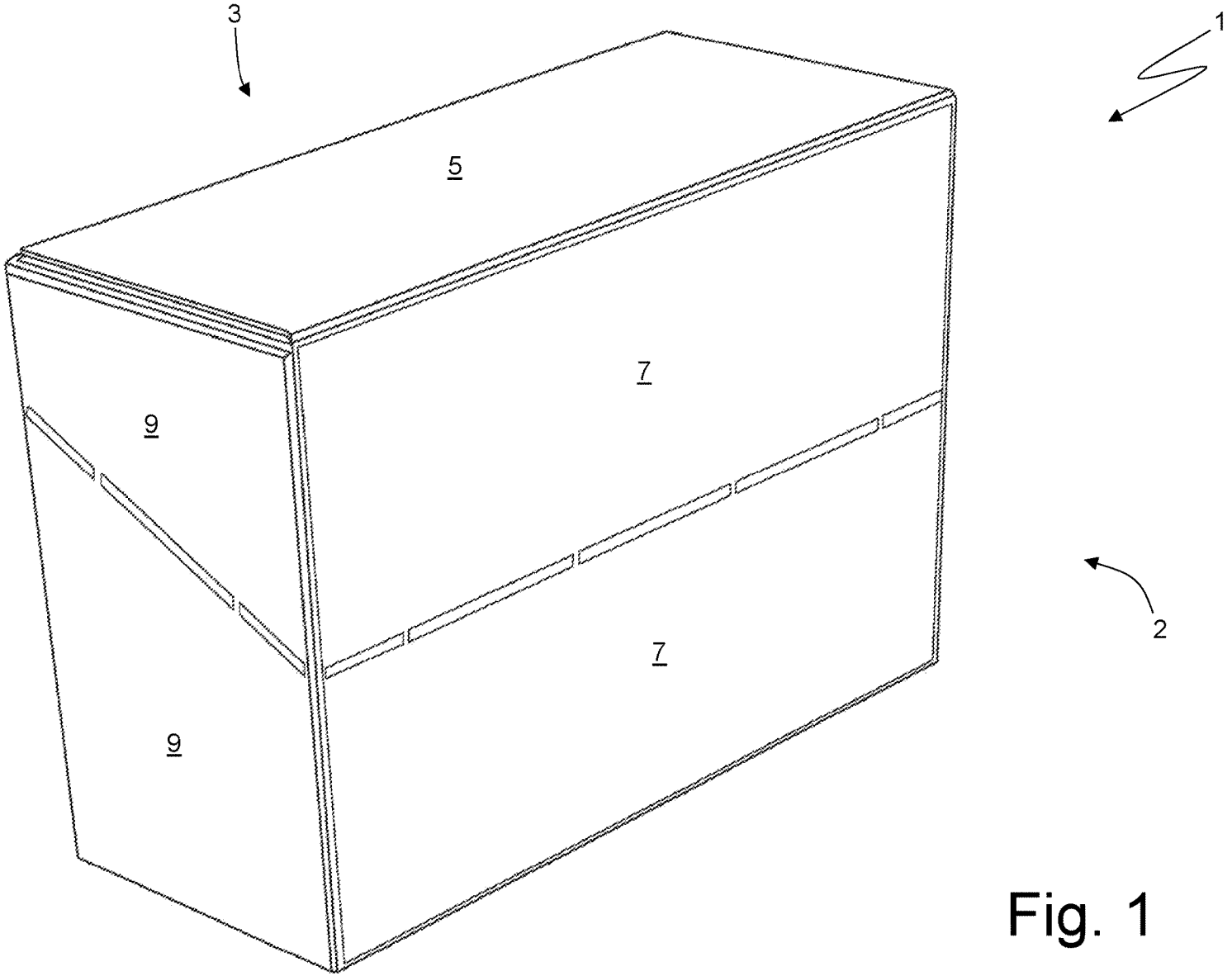
FIG. 1 is a front perspective view and in a closed configuration of a rigid pack of smoking articles realized in accordance with the present invention.
Figure 2:
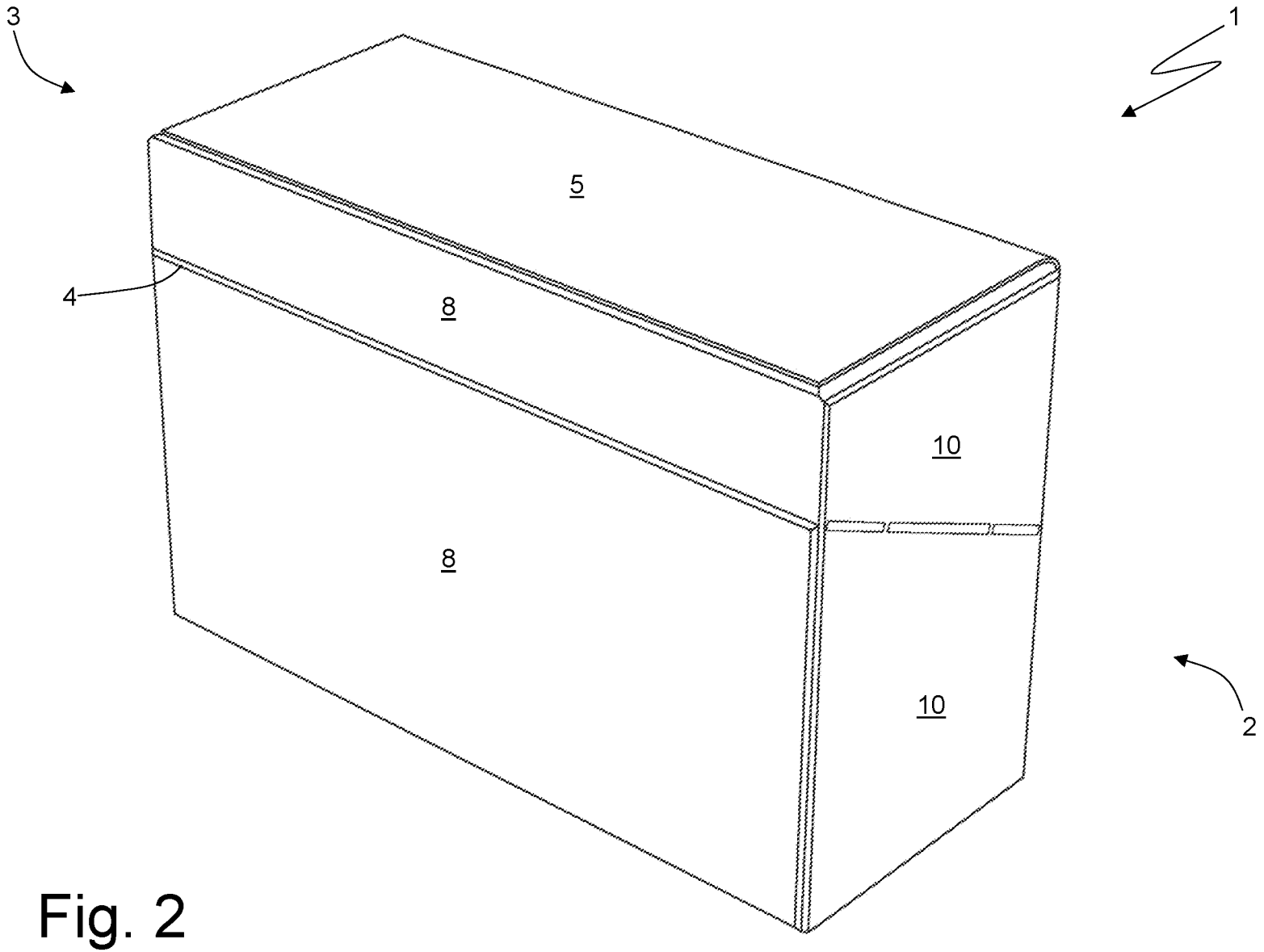
FIG. 2 is a rear perspective view of the pack of FIG. 1 in a closed configuration.
Figure 3:
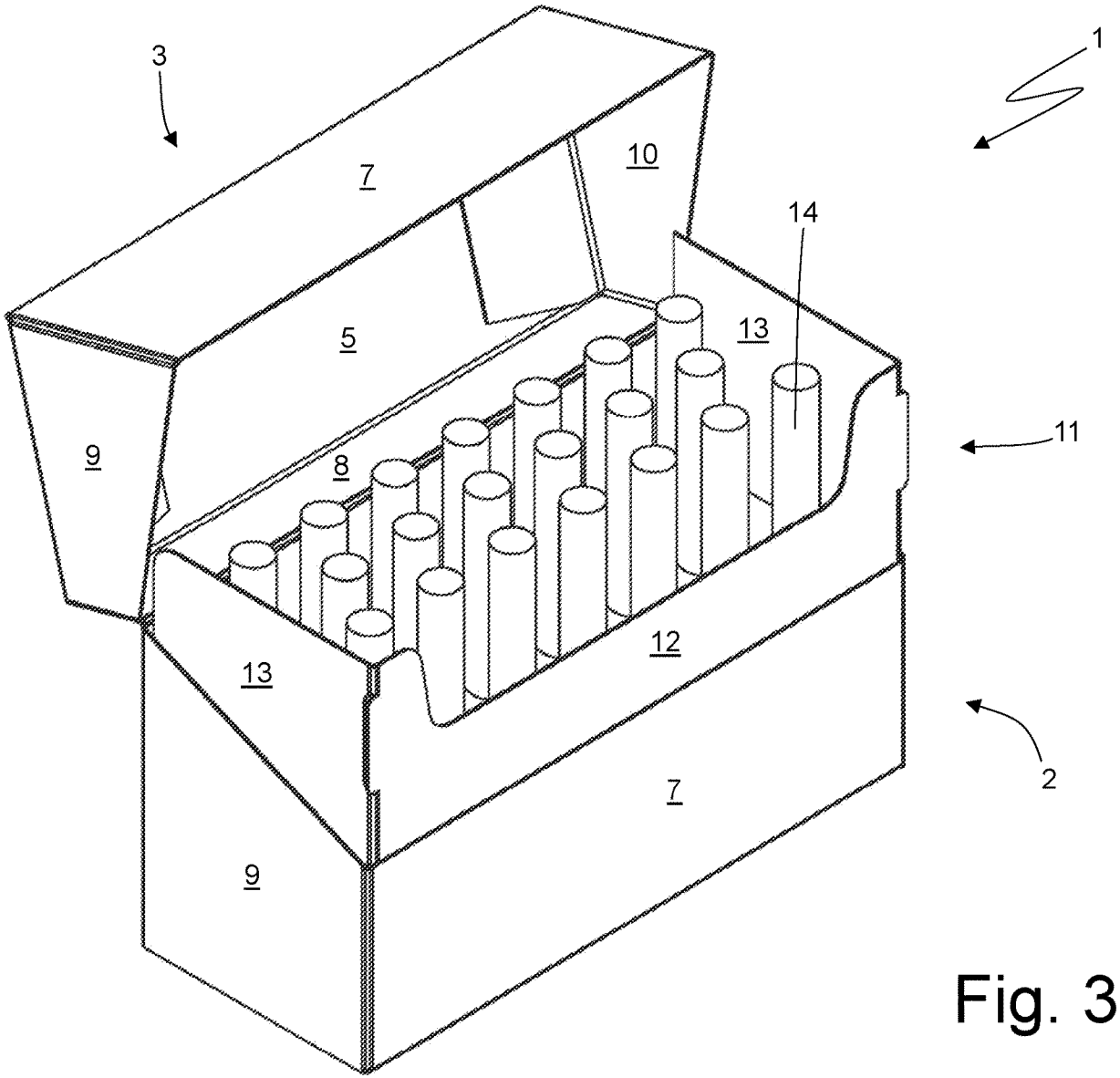
FIG. 3 is a front perspective view of the pack of FIG. 1 in an open configuration.

In FIGS. 1, 2 and 3, the number 1 denotes a rigid pack for smoking articles as a whole.

The pack 1 comprises a parallelepiped-shaped container 2 which is made of cardboard or rigid paperboard and is provided with a boxed lid 3 and hinged along a hinge 4 (shown in FIG. 2) to rotate between an open position (shown in FIG. 3) and a closed position (shown in FIGS. 1 and 2).

The container 2 has a substantially rectangular parallelepiped shape and has an upper wall 5 (completely belonging to the lid 3), a lower wall 6 opposite to the upper wall 5, a front wall 7 (partly belonging to the lid 3) and a rear wall 8 (partly belonging to the lid 3 and in which the hinge 4 is obtained) which are parallel and opposite to each other, and two side walls 9 and 10 (partly belonging to the lid 3) which are parallel and opposite to each other. Between the front walls 7-10 of the container 2, there are defined four longitudinal corners (which may be sharp as shown in the accompanying figures, chamfered or rounded), and between the walls 7-10 and the walls 5-6 of the container 2, there are defined eight transverse corners (which may be sharp as shown in the accompanying figures, chamfered or rounded).

According to what is shown in FIG. 3, the pack 1 further comprises a rigid collar 11, which is connected (by gluing) bent in a "U" shape inside the container 2 in order to partially project outside of an open upper end of the container 2 and engage a corresponding inner surface of the lid 3, when the lid 3 is arranged in the closed position. The collar 11 comprises a front wall 12 which is glued (obviously below the lid 3) to the front wall 7 of the container 2 and two side walls 13 which are glued (obviously below the lid 3) to the side walls 9 and 10 of the container 2.

The pack 1 comprises a group of rod-shaped smoking articles 14 (e.g. rigid cartridges for electronic cigarettes), each of which is shaped like an elongated cylinder (i.e. having a cross-sectional diameter much smaller than a longitudinal extension). In the embodiment shown in FIGS. 1-7, the group consists of twenty smoking articles 14 which are arranged on three layers composed of seven, six and seven smoking articles 14, respectively.

Figure 4:
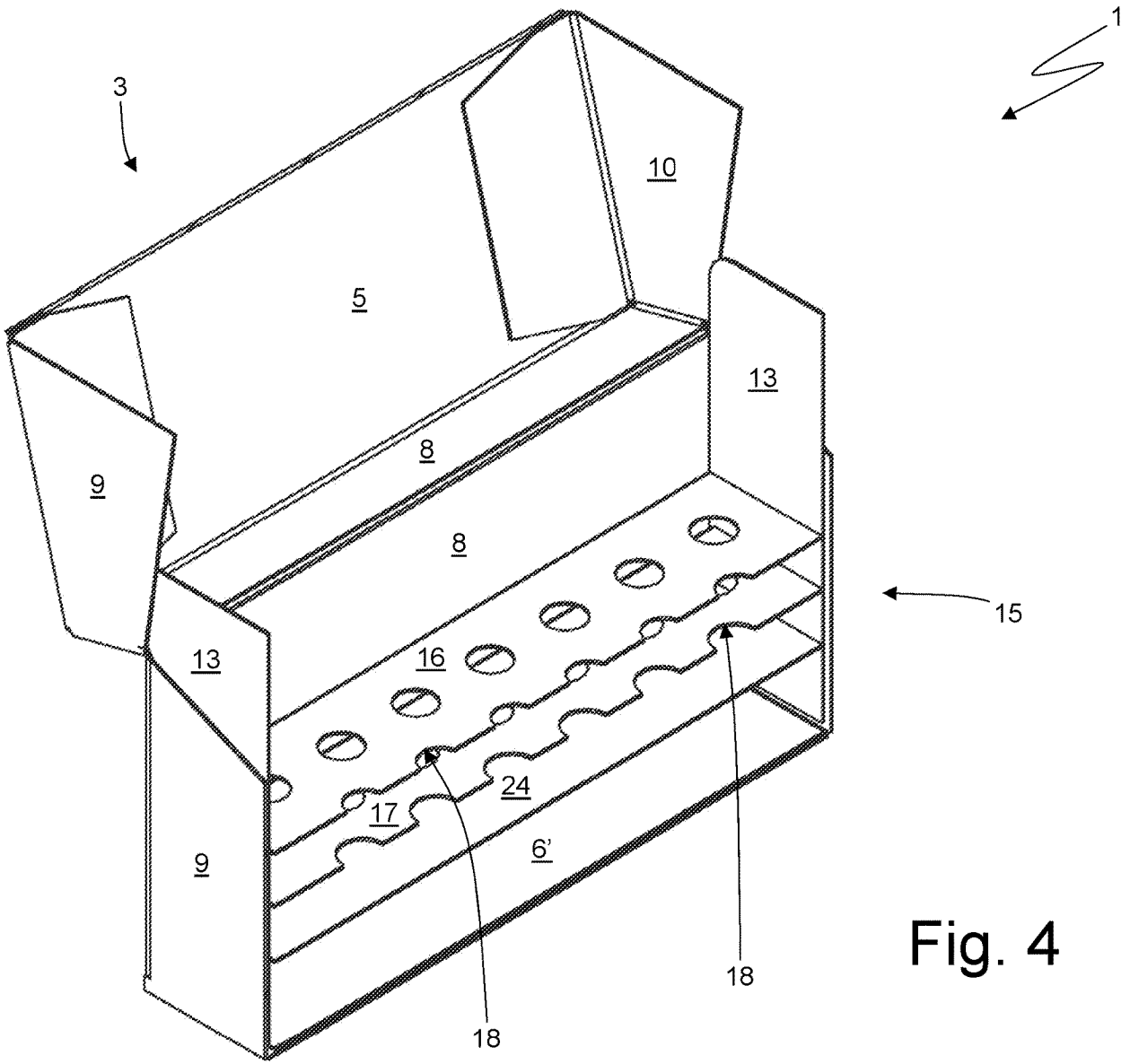
FIGS. 4 and 5 are two different perspective and longitudinal sectional views of the pack of FIG. 1 in a closed configuration and with the smoking articles removed for clarity's sake.
Figure 5:
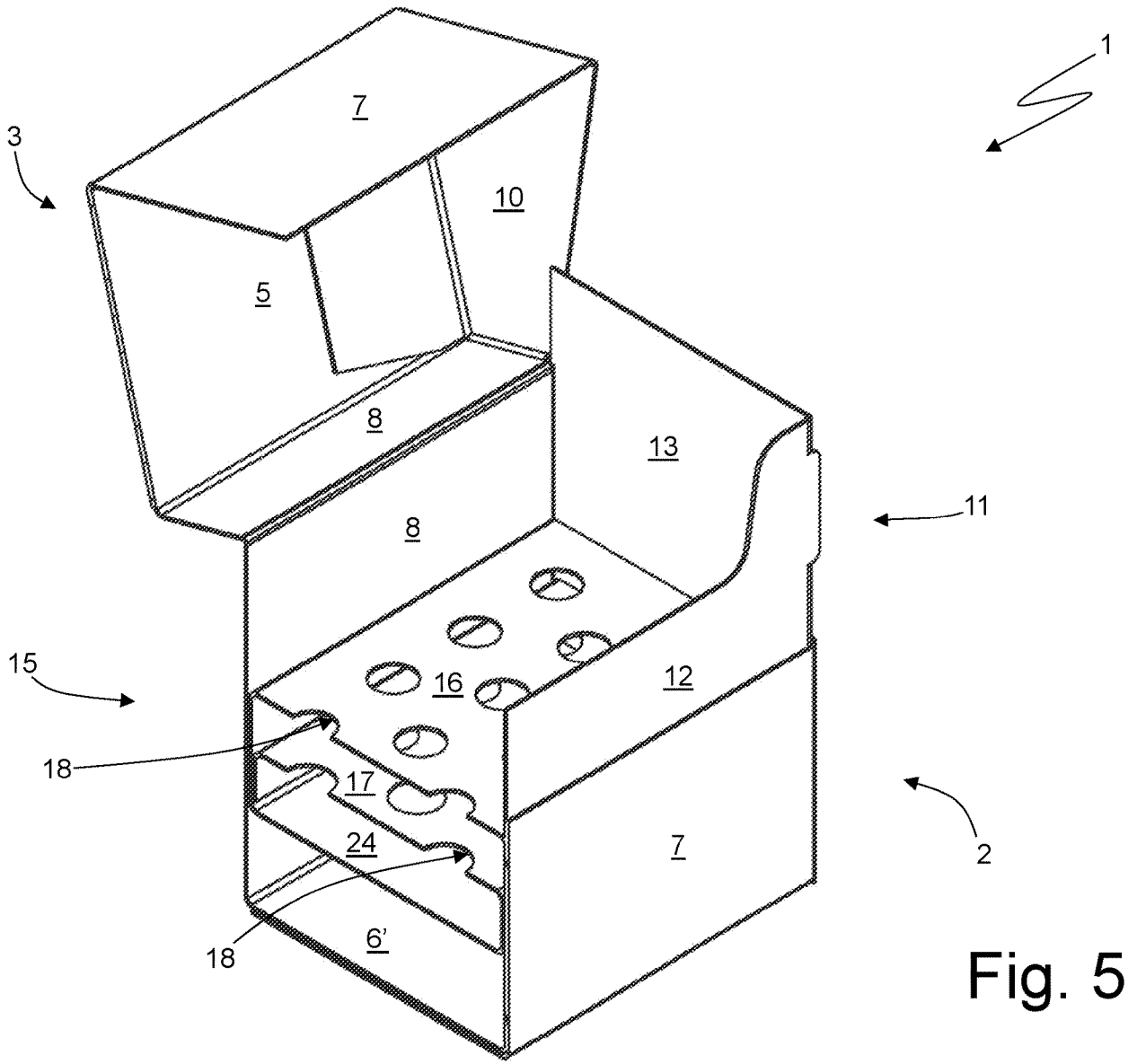
Figure 6:
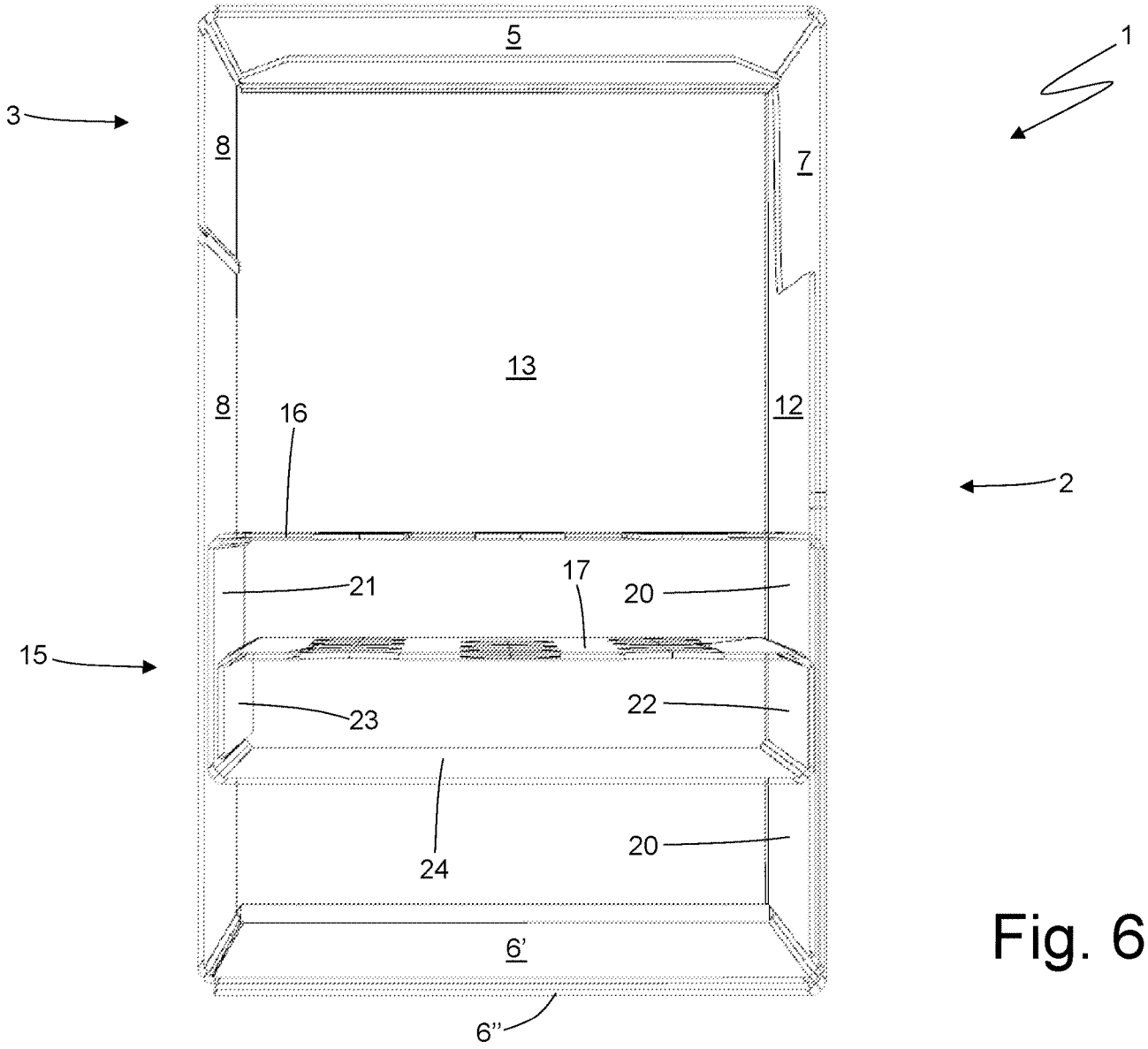
FIG. 6 is a side and longitudinal sectional view of the pack of FIG. 1 in a closed configuration and with the smoking articles removed for clarity's sake.

According to what is best shown in FIGS. 4, 5 and 6, the pack 1 comprises a support system 15 that is arranged inside the container 2 and defines a series of seats each adapted to contain a single smoking article 14 while keeping the smoking article 14 separate and at a certain distance from the adjacent smoking articles 14. This makes it easy to grasp each smoking article 14 (as it is spaced apart from the adjacent smoking articles 14) in order to extract the smoking article 14 from the pack 1. The support system 15 comprises two containing walls 16 and 17 which are arranged at a certain distance from each other parallel to the upper wall 5 and to the lower wall 6 of the container 2, are arranged perpendicular to the smoking articles 14 (i.e. to the longitudinal axis of the smoking articles 14), and have a plurality of through holes 18 each of which is engaged by a corresponding smoking article 14 in order to define a certain and predetermined position of the smoking article 14. The set of two holes 18 aligned with each other defines a seat for a corresponding smoking article 14; that is, a smoking article 14 engaging two holes 18 aligned with each other of the two containing walls 16 and 17 is in a predetermined and stable position within the container 2.

The containing wall 16 is connected at one end and along a pre-weakened transverse bending line 19 (better shown in FIG. 7) to a support tab 20 which is bent by 90° relative to the connection wall 16 and directly (i.e. with direct contact) rests against the front wall 12 of the collar 11 which in turn directly rests against the front wall 7 of the container 2; furthermore, the containing wall 16 is connected at an opposite end (relative to the support tab 20) and along a pre-weakened transverse bending line 19 (better shown in FIG. 7) to a support tab 21 which is bent by 90° relative to the connection wall 16 and directly (i.e. with direct contact) rests against the rear wall 8 of the container 2. As a result, the support tabs 20 and 21 are parallel to and facing each other.

The containing wall 17 is connected at one end and along a pre-weakened transverse bending line 19 (best shown in FIG. 7) to a support tab 22 which is bent by 90° relative to the connection wall 17 and rests against the front wall 12 of the collar 11 (which in turn directly rests against the front wall 7 of the container 2) with the interposition of the support tab 20 (i.e. it rests against the support tab 20 which in turn directly rests against the front wall 12 of the collar 1); furthermore, the containing wall 17 is connected at an opposite end (relative to the support tab 22) and along a pre-weakened transverse bending 19 (better shown in FIG. 7) to a support tab 23 which is bent by 90° relative to the connection wall 16 and rests against the rear wall 8 of the container 2 with the interposition of the support tab 21 (i.e. it rests against the support tab 21 which in turn directly rests against the rear wall 8 of the container 2). As a result, the support tabs 22 and 23 are parallel to and facing each other.

According to a preferred embodiment, the support tab 21 rests against and is glued to the rear wall 8 of the container 2, the support tab 22 rests against and is glued to the support tab 20, and the support tab 23 rests against and is glued to the support tab 21; on the other hand, the support tab 20 only rests against, but not glued to, the front wall 12 of the collar 11 (which in turn rests against and is glued to the front wall 7 of the container 2) to allow the support tab 20 to be separated from the front wall 12 of the collar 11 (a feature that will be used during the manufacture of the rigid pack 1 as will be described below).

The support system 15 comprises a connection wall 24 which is parallel to the containing walls 16 and 17 (and therefore also to the lower wall 6 of the container 2 and to the upper wall 5 of the container 2) and connects the support tabs 21 and 22 to each other; the connection wall 24 is arranged below both containing walls 16 and 17, i.e. starting from the top (the upper wall 5) and going downwards (the lower wall 6) they are provided in succession as follows: the containing wall 16, the containing wall 17 and the connection wall 24. The connection wall 24 is connected at one end and along a pre-weakened transverse bending line 19 (best shown in FIG. 7) to the support tab 21 and is connected at the opposite end and along a pre-weakened transverse bending line 19 (best shown in FIG. 7) to the support tab 22. As a result, the support tabs 21 and 22 (which are parallel to and facing each other) are bent by 90° relative to the connection wall 24.

The support tab 20 is connected along a pre-weakened transverse bending line 19 (better shown in FIG. 7) to the lower wall 6 of the container 2 (in particular to a panel 6' which constitutes an inner part of the lower wall 6 of the container 2) and is bent by 90° relative to the lower wall 6 of the container 2 (in particular relative to the panel 6' which constitutes an inner part of the lower wall 6 of the container 2).

Figure 7:
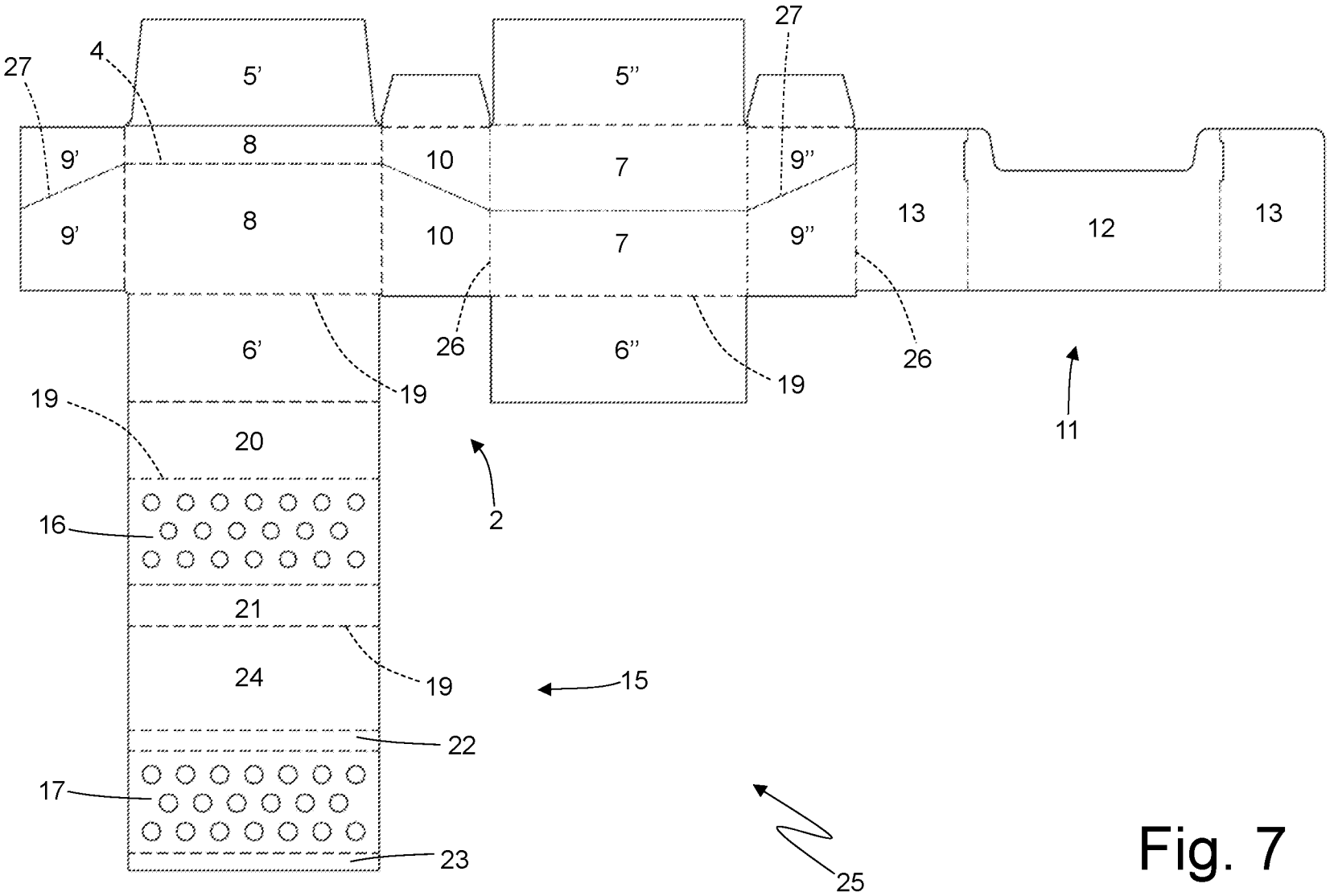
FIG. 7 is a plan view of a blank used to manufacture the pack of FIG. 1.

According to what is shown in FIG. 7, the container 2, the collar 11 and the support system 15 are manufactured using a single blank 25 comprising: a panel 5' which constitutes an inner part of the upper wall 5 of the container 2, the rear wall 8 of the container 2 which is connected to the panel 5' along a pre-weakened transverse bending line 19, a panel 6' which constitutes an inner part of the lower wall 6 of the container 2 and is connected to the rear wall 8 along a pre-weakened transverse bending line 19, the support tab 20 connected to the panel 6' along a pre-weakened transverse bending line 19, the containing wall 16 connected to the support tab 20 along a pre-weakened transverse bending line 19, the support tab 21 connected to the containing wall 16 along a pre-weakened transverse bending line 19, the connection wall 24 connected to the support tab 21 along a pre-weakened transverse bending line 19, the support tab 22 connected to the connection wall 24 along a pre-weakened transverse bending line 19, the containing wall 17 connected to the support tab 22 along a pre-weakened transverse bending line 19, and the support tab 23 connected to the containing wall 17 along a pre-weakened transverse bending line 19.

The blank 25 comprises a panel 9' which is arranged on one side of the rear wall 8, is connected to the rear wall 8 along a pre-weakened longitudinal bending line 26, and constitutes an outer part of the side wall 9; further, the blank 25 comprises the other side wall 10 which is arranged on a side of the rear wall 8 opposite to the panel 9' and is connected to the rear wall 8 along a pre-weakened longitudinal bending line 26.

The blank 25 comprises: the front wall 7 which is connected to the side wall 10 along a pre-weakened longitudinal bending line 26, a panel 9" which is connected to the front wall 7 from the opposite side of the side wall 10 and along a pre-weakened longitudinal bending line 26 and constitutes an inner part of the side wall 9 by being overlapped and glued to the panel 9', a side wall 13 of the collar 11 which is connected to the panel 9" along a pre-weakened longitudinal bending line 26, the front wall 12 of the collar 11 which is connected to the side wall 13 along a pre-weakened longitudinal bending line 26, and the other side wall 13 of the collar 11 which is connected to the front wall 12 along a pre-weakened longitudinal bending line 26.

Finally, the blank 25 comprises a panel 5" which constitutes an outer part of the upper wall 5 of the container 2 being overlapped and glued to the panel 5' and connected to the front wall 7 of the container 2 along a pre-weakened transverse bending line 19, and a panel 6" which constitutes an outer part of the lower wall 6 of the container 2 being overlapped and glued to the panel 6' and which is connected to the front wall 7 of the container 2 along a pre-weakened transverse bending line 19.

In the blank 25, the front wall 7 and the side walls 9 and 10 are crossed by a pre-weakened separation line 27 which connects to the hinge 4 of the lid 3 and separates the portions belonging to the lid 3 from the remaining portions not belonging to the lid 3; after the first opening of the rigid pack 1, the pre-weakened separation line 27 is definitively broken to allow the lid 3 to be separated from the rest of the container 2 by rotating around the hinge 4.

Figure 8:
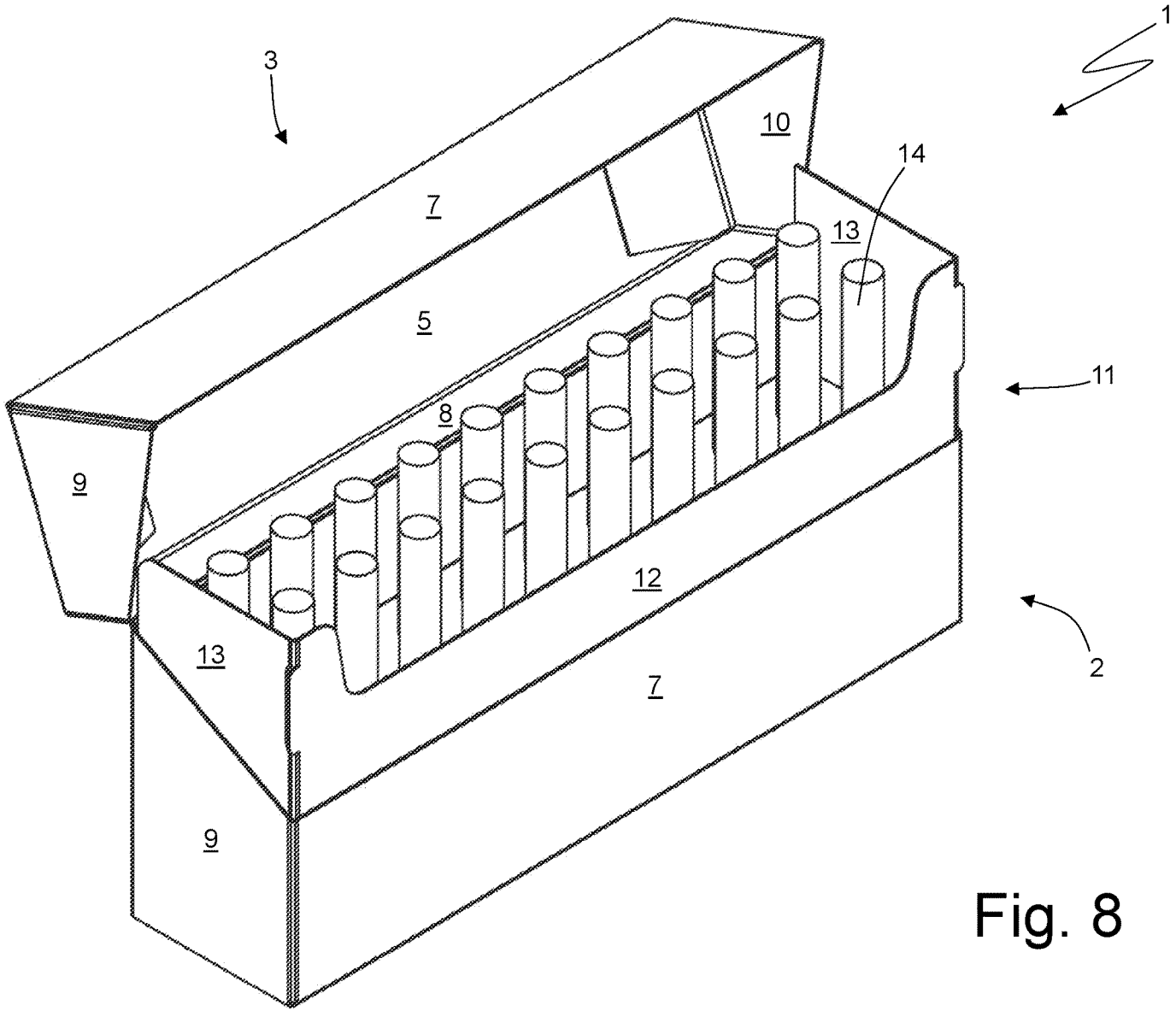
FIG. 8 is a front perspective view of a variant of the pack of FIG. 1 in an open configuration.
Figure 9:
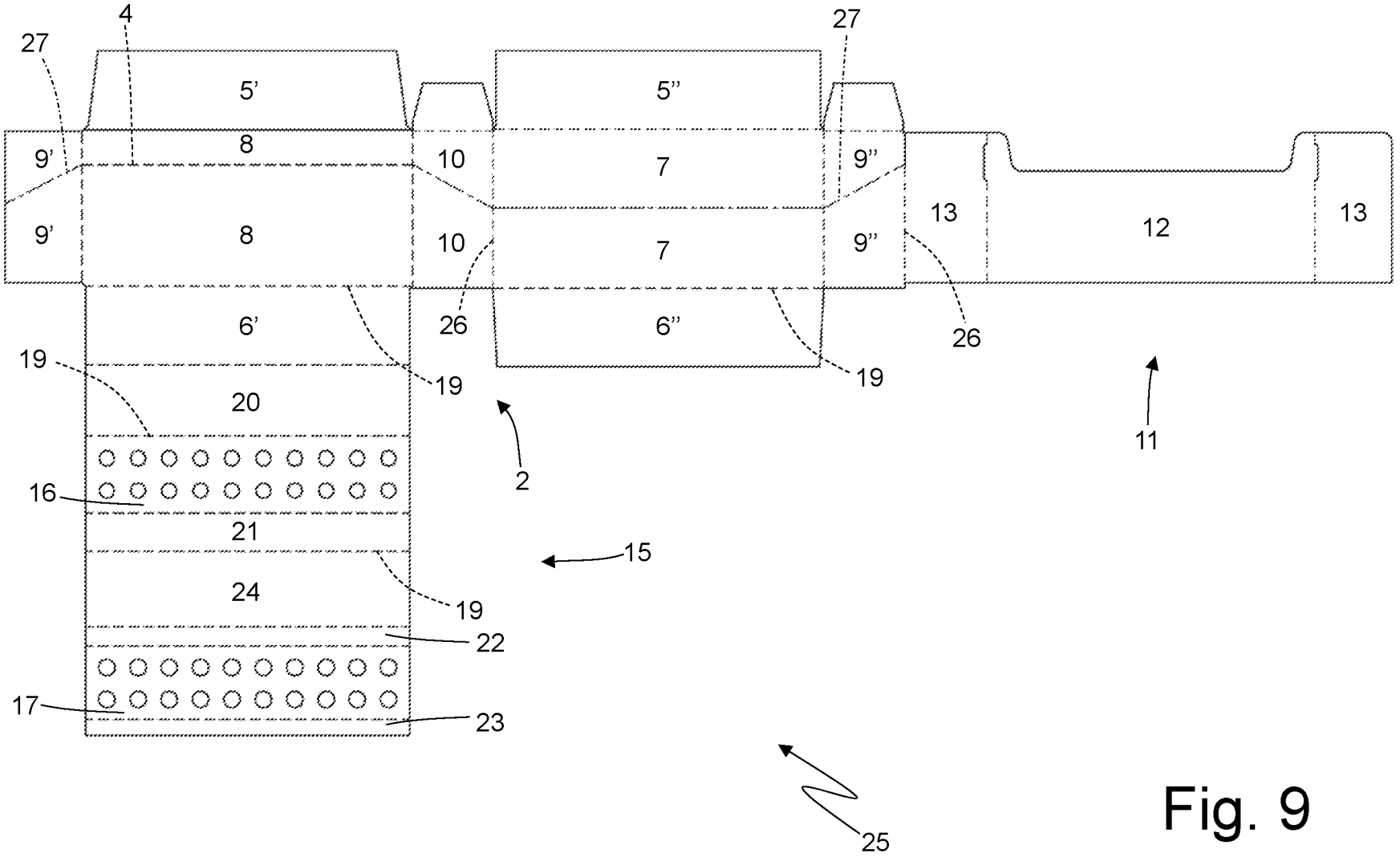
FIG. 9 is a plan view of a blank used to manufacture the pack of FIG. 8.

FIG. 8 shows a variant of the rigid pack 1: the rigid pack 1 shown in FIG. 8 differs from the rigid pack 1 shown in FIGS. 1-6 in its proportions (in particular, the rigid pack 1 shown in FIG. 8 is narrower and wider than the rigid pack 1 shown in FIGS. 1-6) and in the arrangement of the smoking articles 14 (in the rigid pack 1 shown in FIG. 8, the group of smoking articles 14 consists of twenty smoking articles 14 which are arranged on two layers consisting of ten smoking articles 14, respectively). FIG. 9 shows the blank 25 being used to manufacture the rigid pack 1 shown in FIG. 8.

Figure 10:
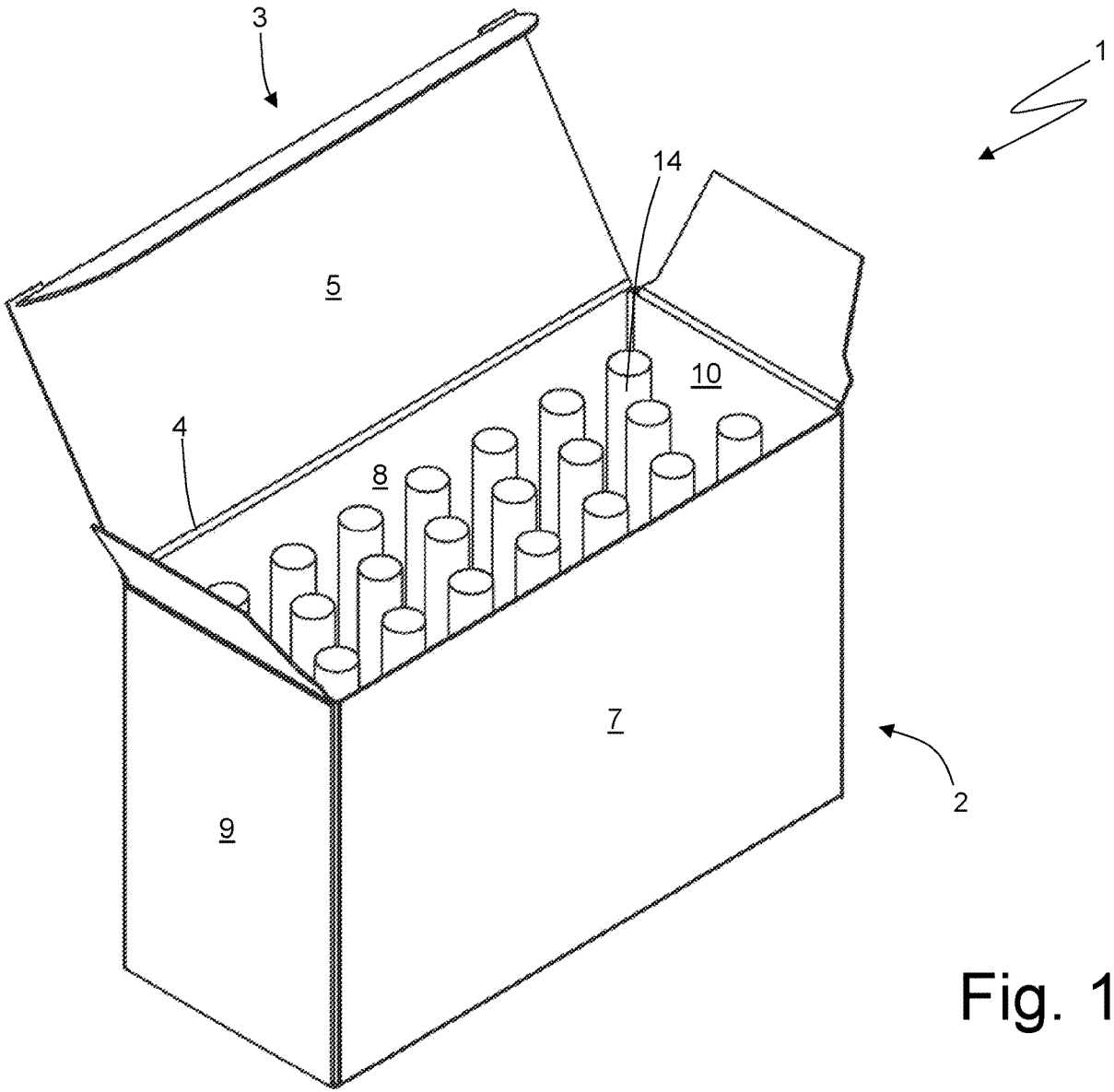
FIG. 10 is a front perspective view of another variant of the pack of FIG. 1 in an open configuration.
Figure 11:
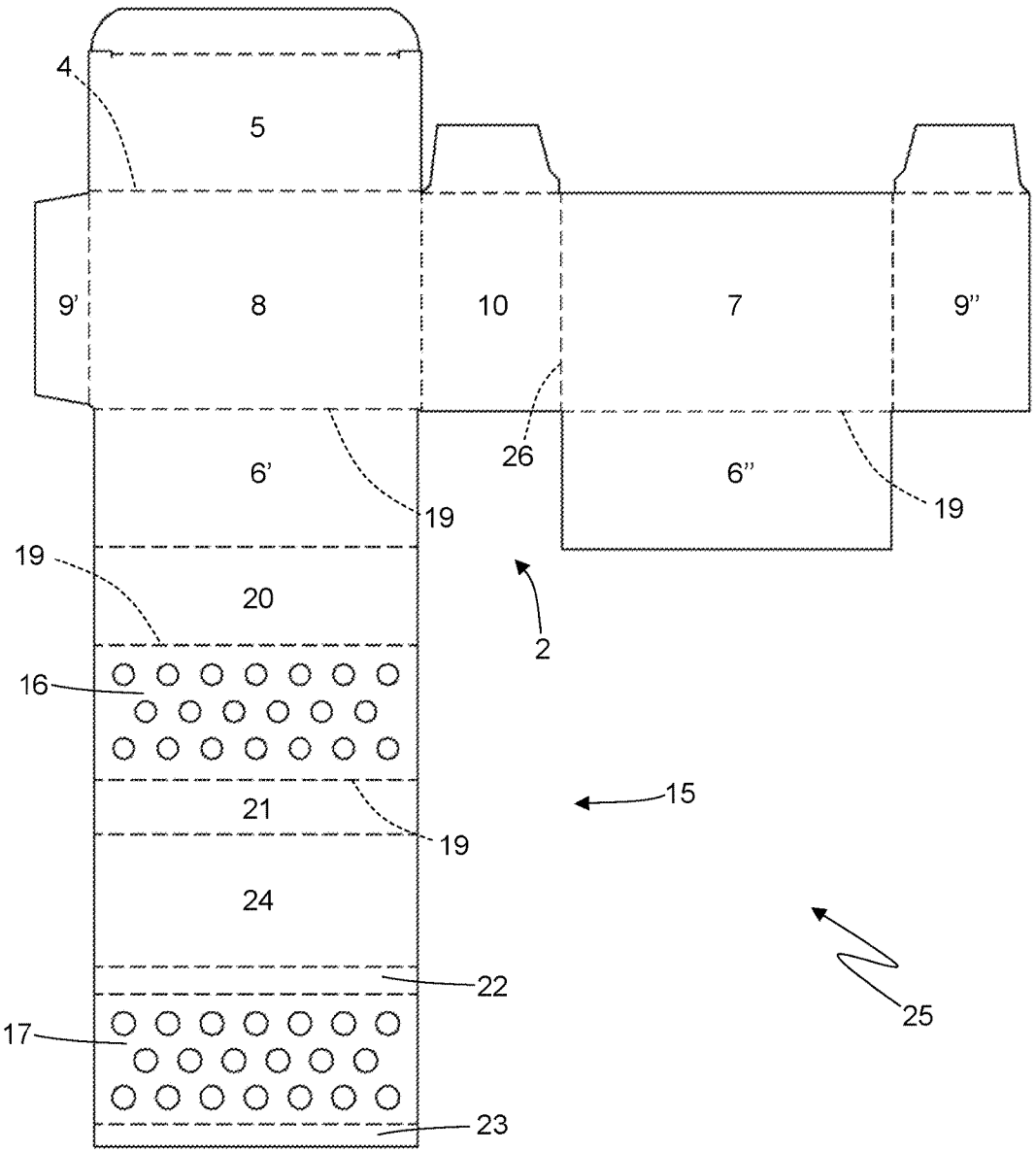
FIG. 11 is a plan view of a blank used to manufacture the pack of FIG. 10.

FIG. 10 shows another variant of the rigid pack 1: the rigid pack 1 shown in FIG. 10 differs from the rigid pack 1 shown in FIGS. 1-6 in the conformation of the lid 3: in the rigid pack 1 shown in FIG. 10, the lid 3 is not boxed but is substantially composed only of the upper wall 5 and consequently there is no collar 11 (whose function, i.e. keeping the lid 3 in the closed position, is performed by a tab that protrudes from the upper wall 5 and is wedged between the upper wall 5 and the front wall 7). FIG. 11 shows the blank 25 being used to manufacture the rigid pack 1 shown in FIG. 10.

Figure 12:
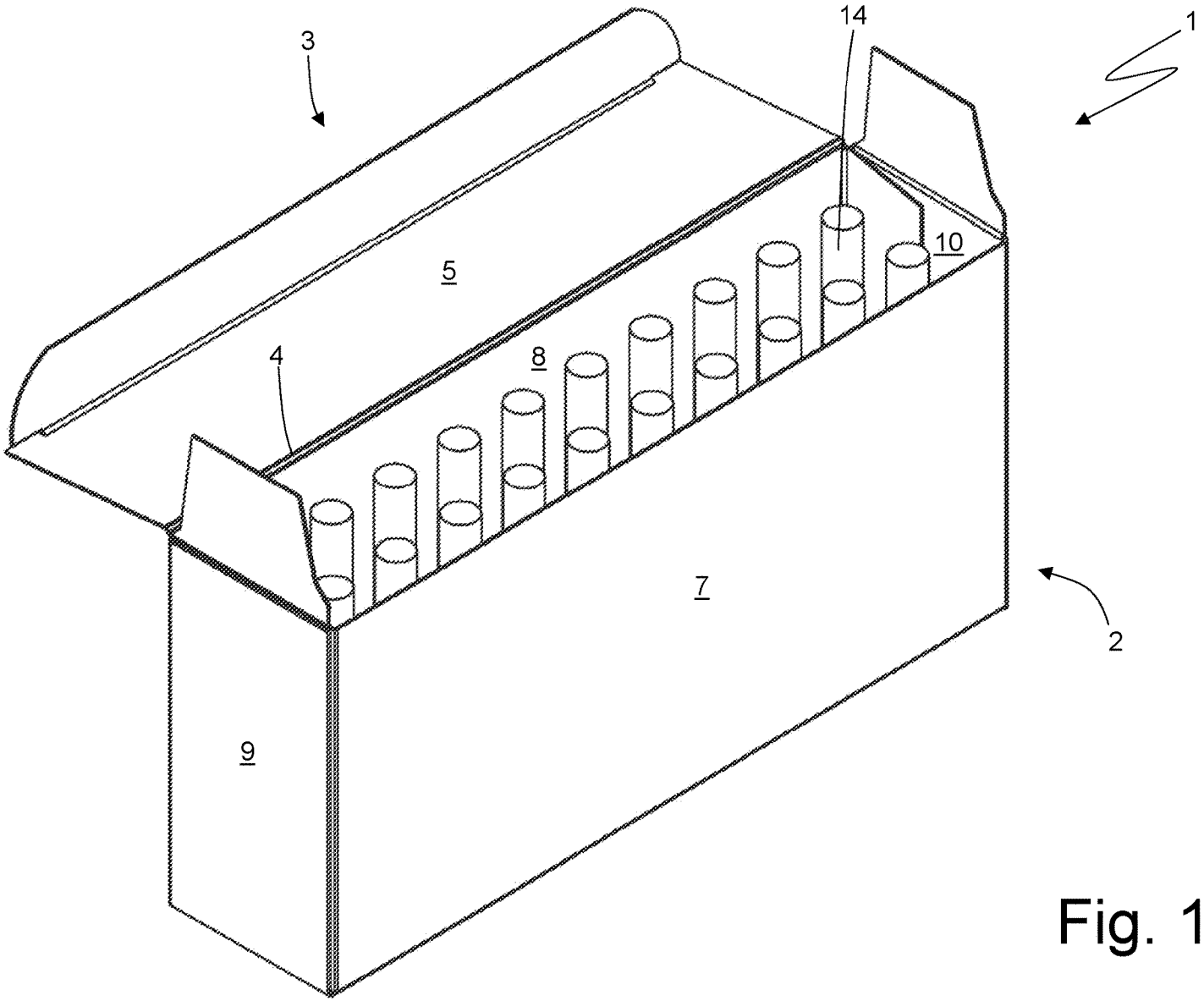
FIG. 12 is a front perspective view of another variant of the pack of FIG. 1 in an open configuration.
Figure 13:
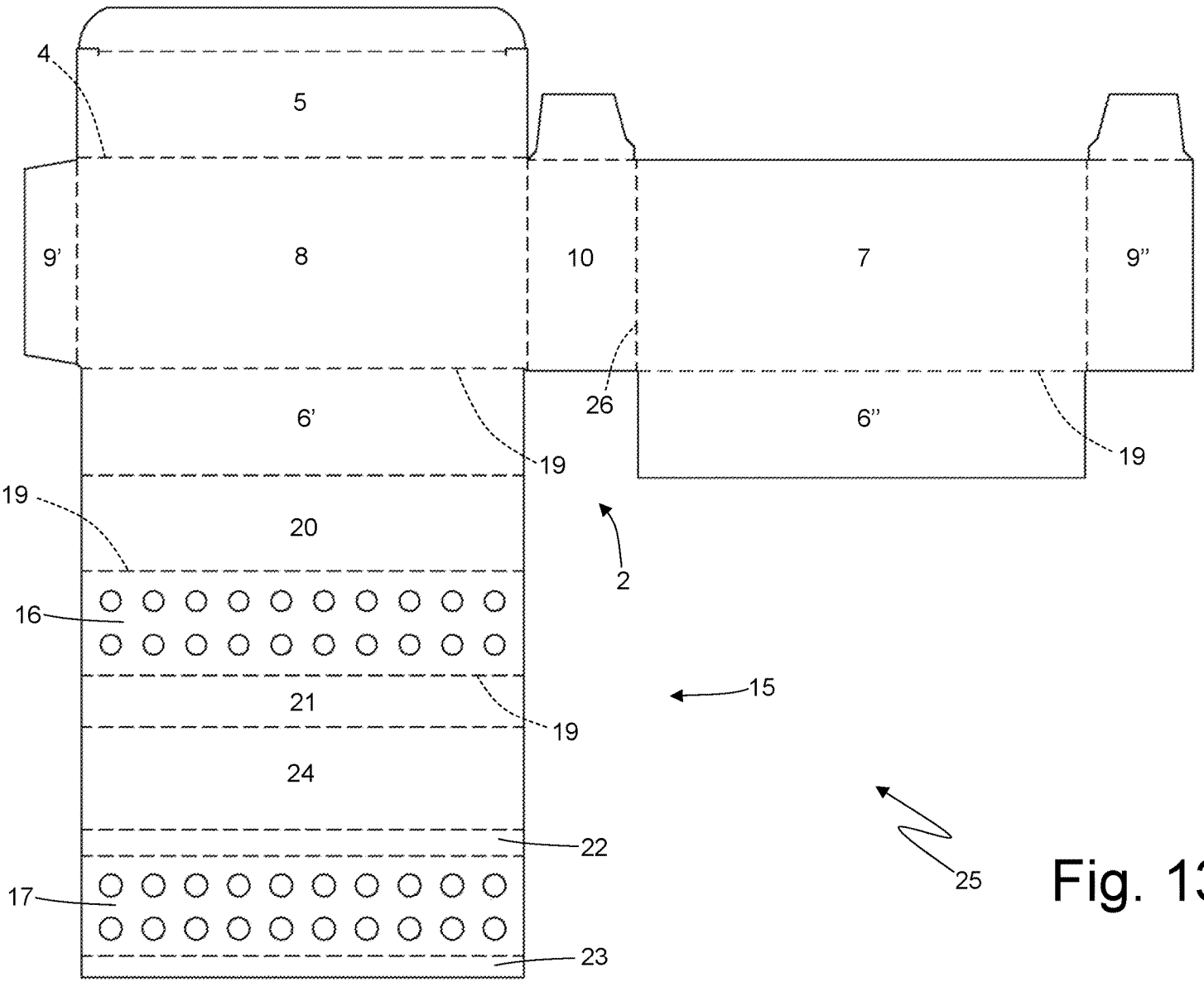
FIG. 13 is a plan view of a blank used to manufacture the pack of FIG. 12.

FIG. 12 shows a variant of the rigid pack 1: the rigid pack 1 shown in FIG. 12 differs from the rigid pack 1 shown in FIG. 10 in its proportions (in particular, the rigid pack 1 shown in FIG. 12 is narrower and wider than the rigid pack 1 shown in FIG. 10) and in the arrangement of the smoking articles 14 (in the rigid pack 1 shown in FIG. 12, the group of smoking articles 14 consists of twenty smoking articles 14 which are arranged on two layers consisting of ten smoking articles 14, respectively). FIG. 13 shows the blank 25 being used to manufacture the rigid pack 1 shown in FIG. 12.

Figure 14:
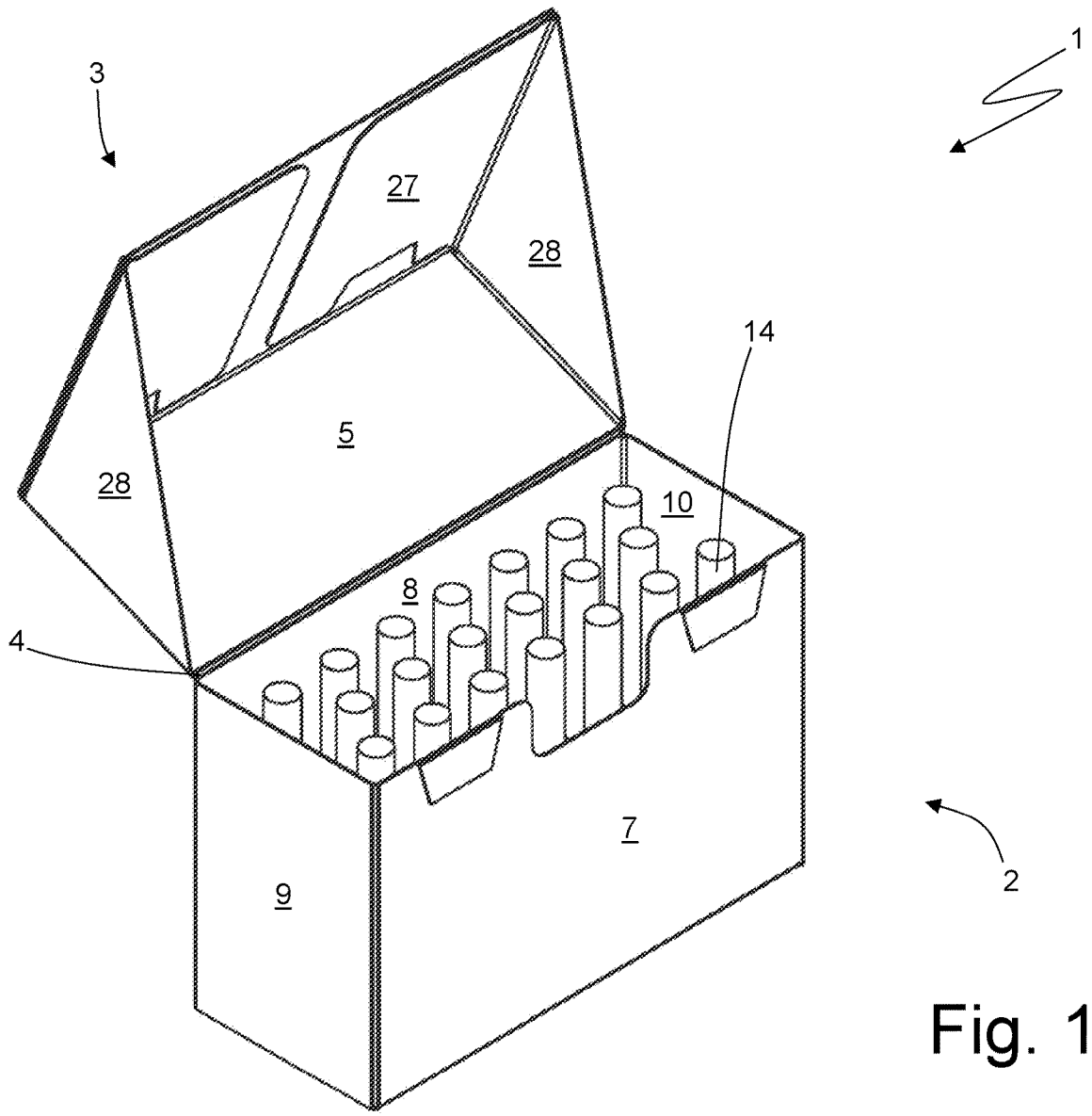
FIG. 14 is a front perspective view of another variant of the pack of FIG. 1 in an open configuration.
Figure 15:
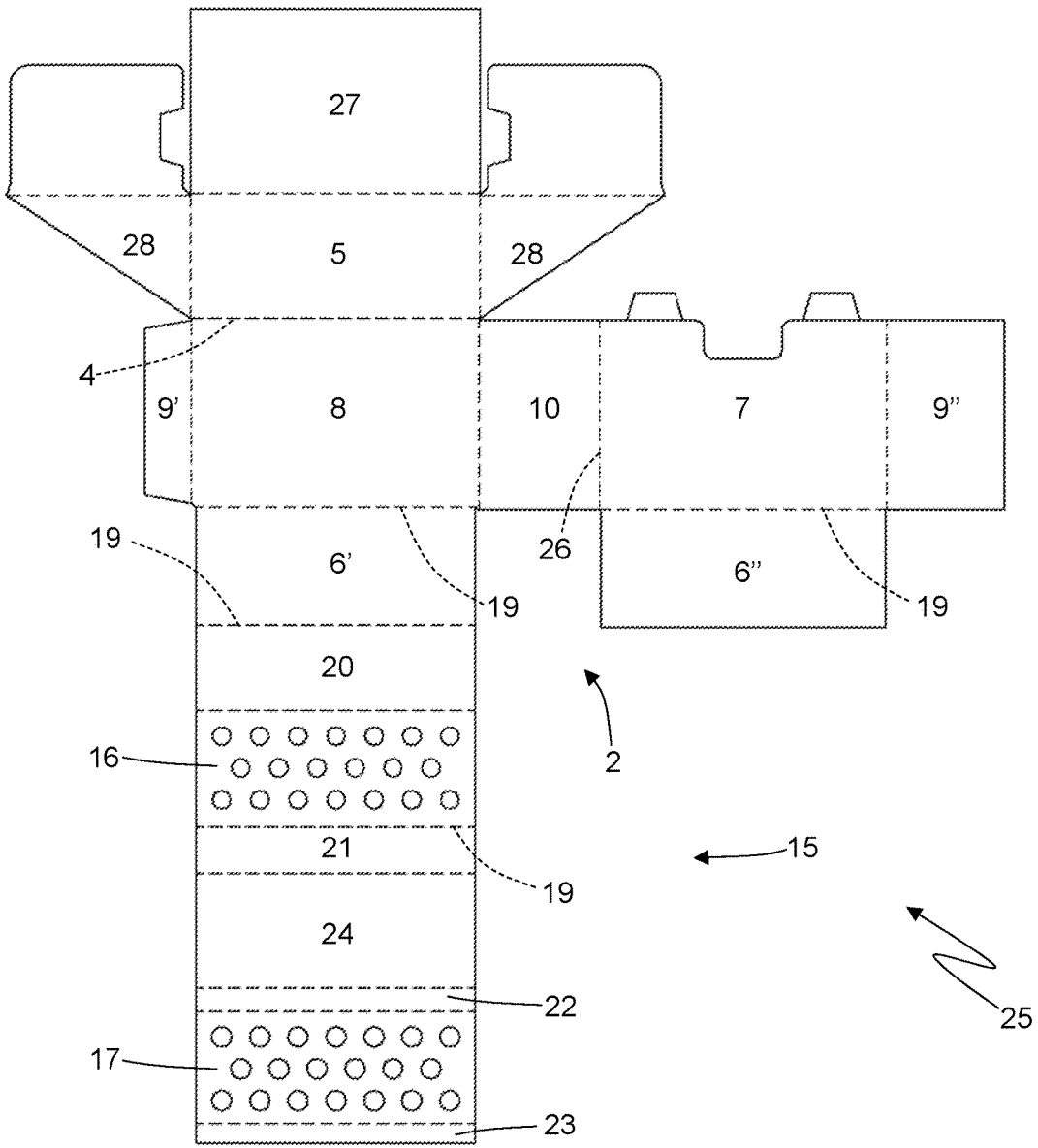
FIG. 15 is a plan view of a blank used to manufacture the pack of FIG. 14.

FIG. 14 shows another variant of the rigid pack 1: the rigid pack 1 shown in FIG. 14 differs from the rigid pack 1 shown in FIGS. 1-6 in the conformation of the lid 3: in the rigid pack 1 shown in FIG. 14 the lid 3 is boxed but instead of being an integral part of the container 2 it is an outer element relative to the container 2, it embraces the container 2 from the outside and has its own front wall 27 and its own side walls 28 which are independent of and completely separate from the respective walls 7, 9 and 10 of the container 2. Furthermore, in the rigid pack 1 shown in FIG. 14 there is no collar 11 whose function is completely unnecessary given the different conformation of the lid 3. FIG. 15 shows the blank 25 being used to manufacture the rigid pack 1 shown in FIG. 14.

Figure 16:
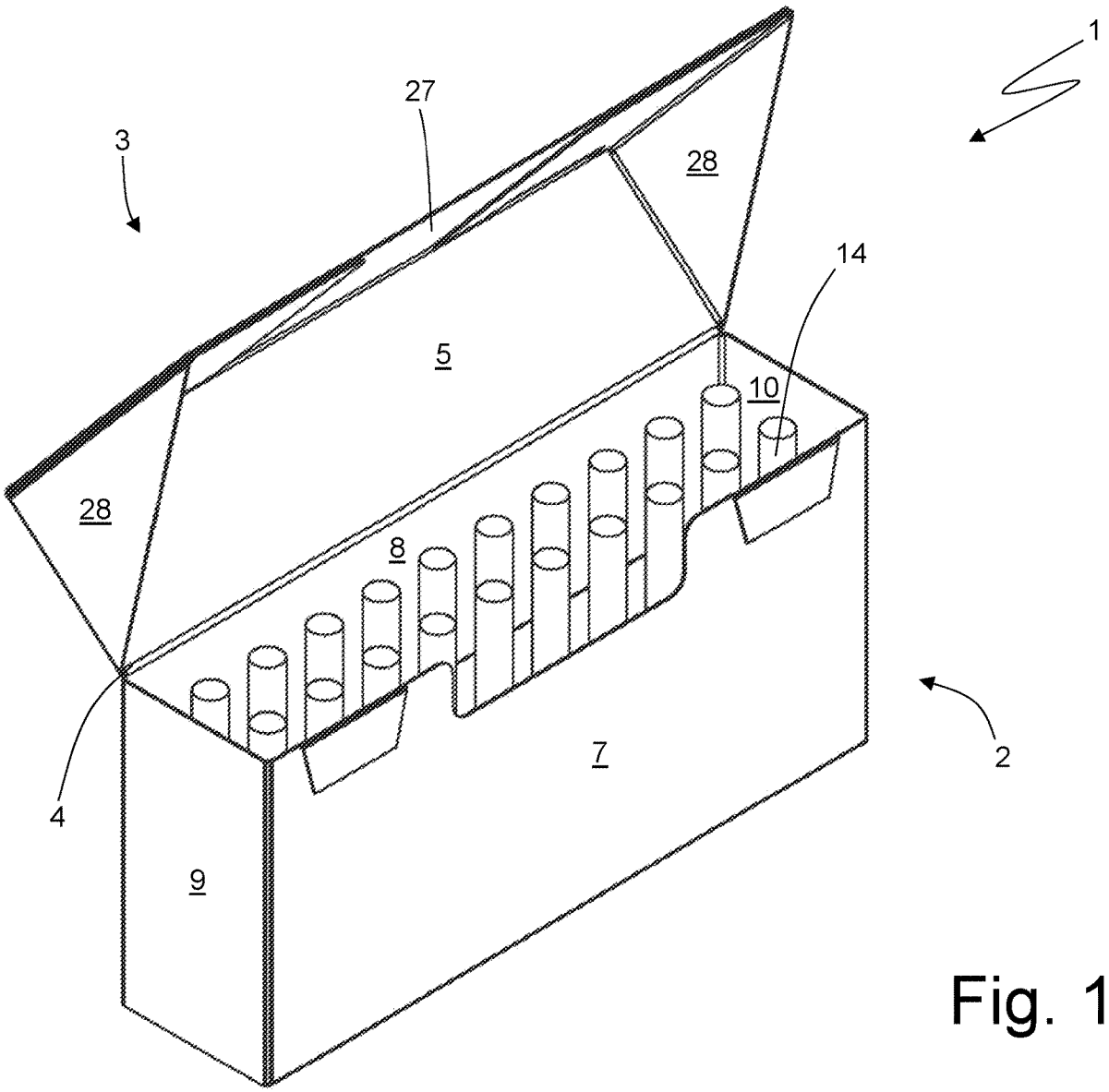
FIG. 16 is a front perspective view of another variant of the pack of FIG. 1 in an open configuration.
Figure 17:
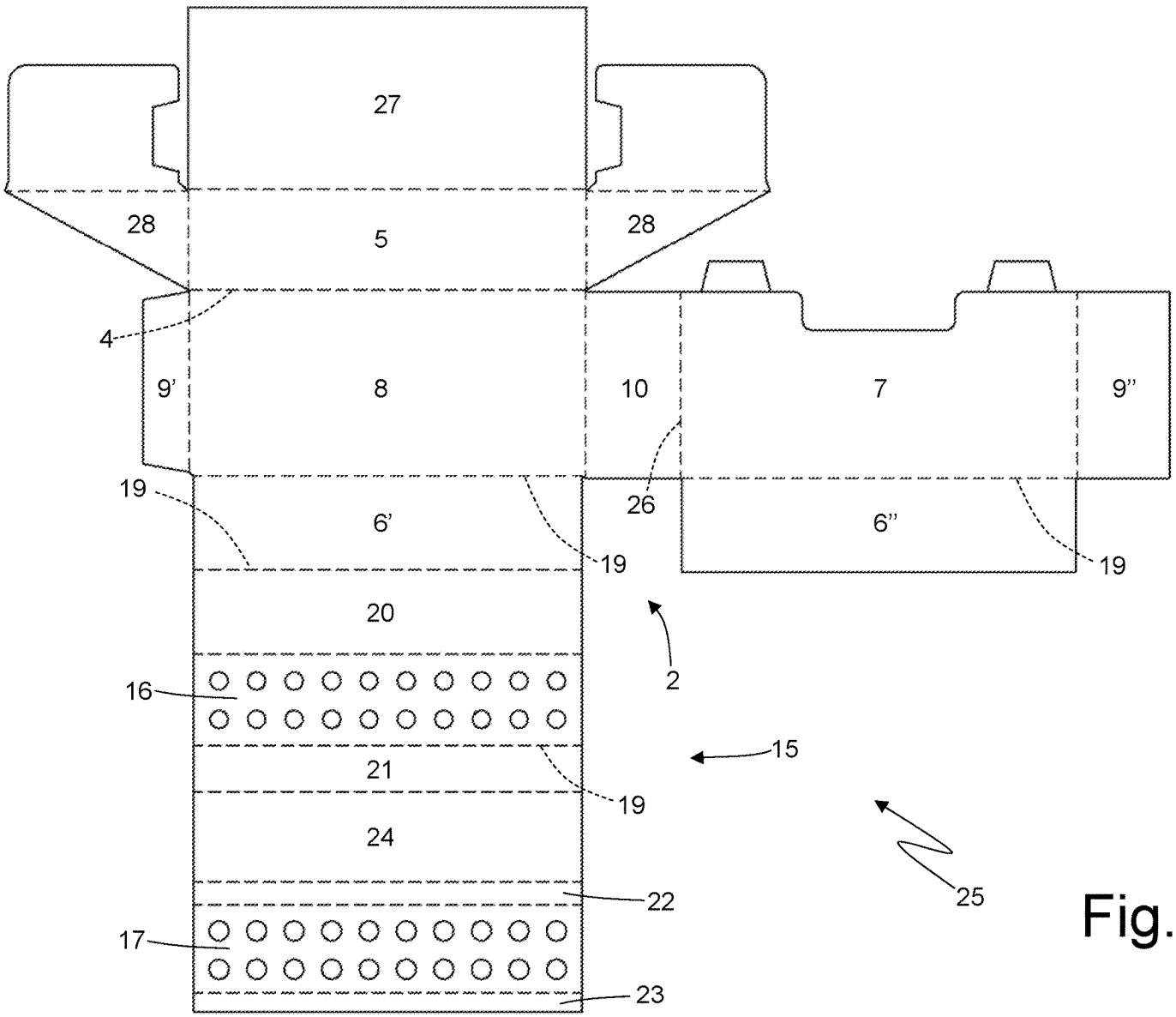
FIG. 17 is a plan view of a blank used to manufacture the pack of FIG. 16.

FIG. 16 shows a variant of the rigid pack 1: the rigid pack 1 shown in FIG. 16 differs from the rigid pack 1 shown in FIG. 14 in its proportions (in particular, the rigid pack 1 shown in FIG. 16 is narrower and wider than the rigid pack 1 shown in FIG. 14) and in the arrangement of the smoking articles 14 (in the rigid pack 1 shown in FIG. 16, the group of smoking articles 14 consists of twenty smoking articles 14 which are arranged on two layers consisting of ten smoking articles 14, respectively). FIG. 17 shows the blank 25 being used to manufacture the rigid pack 1 shown in FIG. 16.

According to a further embodiment not shown, the container 2 is slidably inserted inside a further, more external container and must be extracted by axial sliding in order to access the smoking articles 14; in this further embodiment, the container 2 may be provided with a lid 3 (and thus with an upper wall 5) or may also be without a lid 3 (and thus with an upper wall 5).

The manners to manufacture the rigid pack 1 by bending the blank 25 in order to form the container 2, the collar 11 (if any), and the support system 15 are described below; in describing the manners to bend the blank 25, the blank 25 shown in FIG. 17 is taken as an example, but the bending manners remain substantially the same for all the blanks 25 described above.

Figure 22:
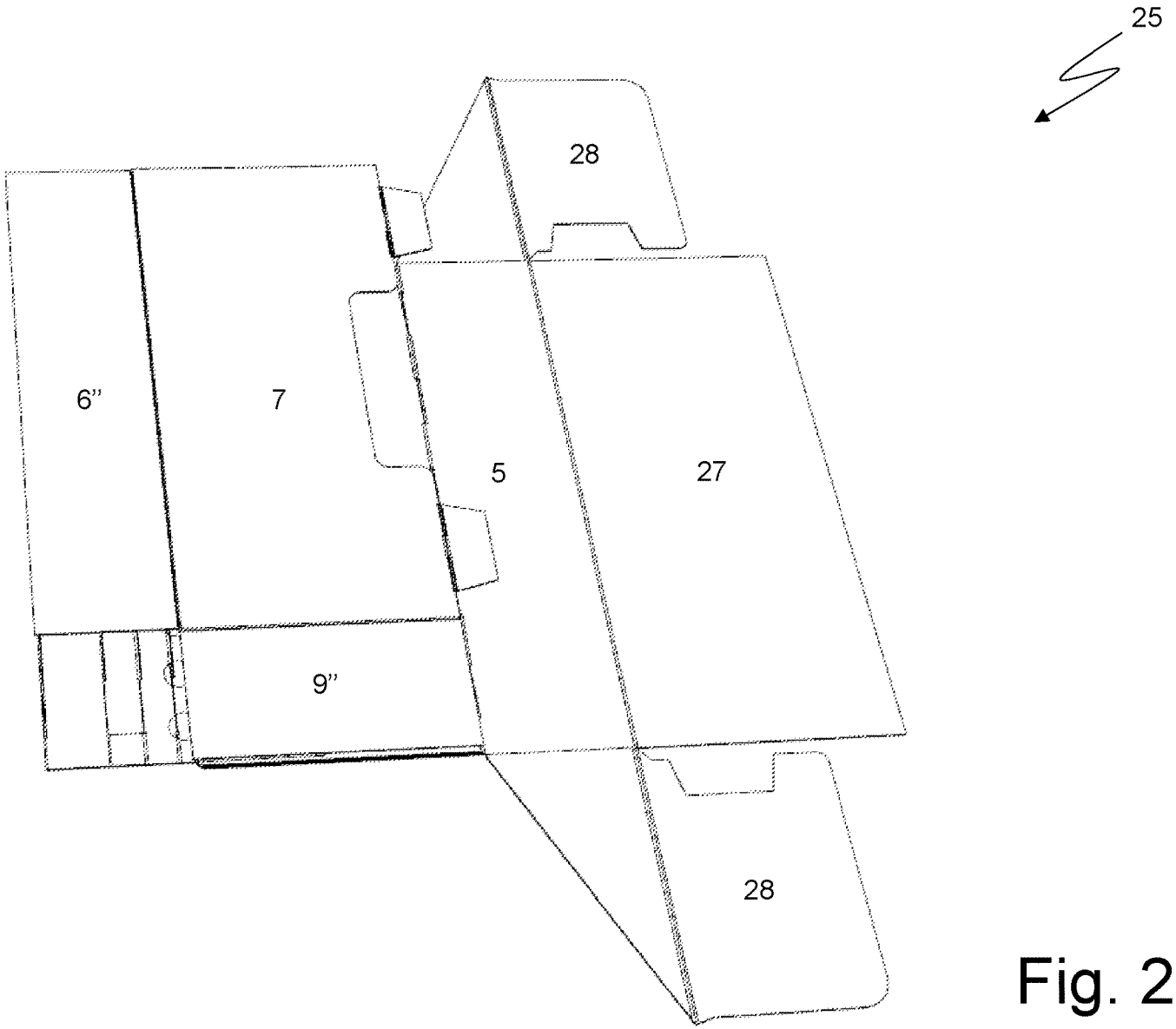

Initially, the blank 25 is bent on itself in order to assume a partially bent but still flat shape (i.e. without delimiting a containment volume in its inside) shown in its final form in FIG. 22.

Figure 18:
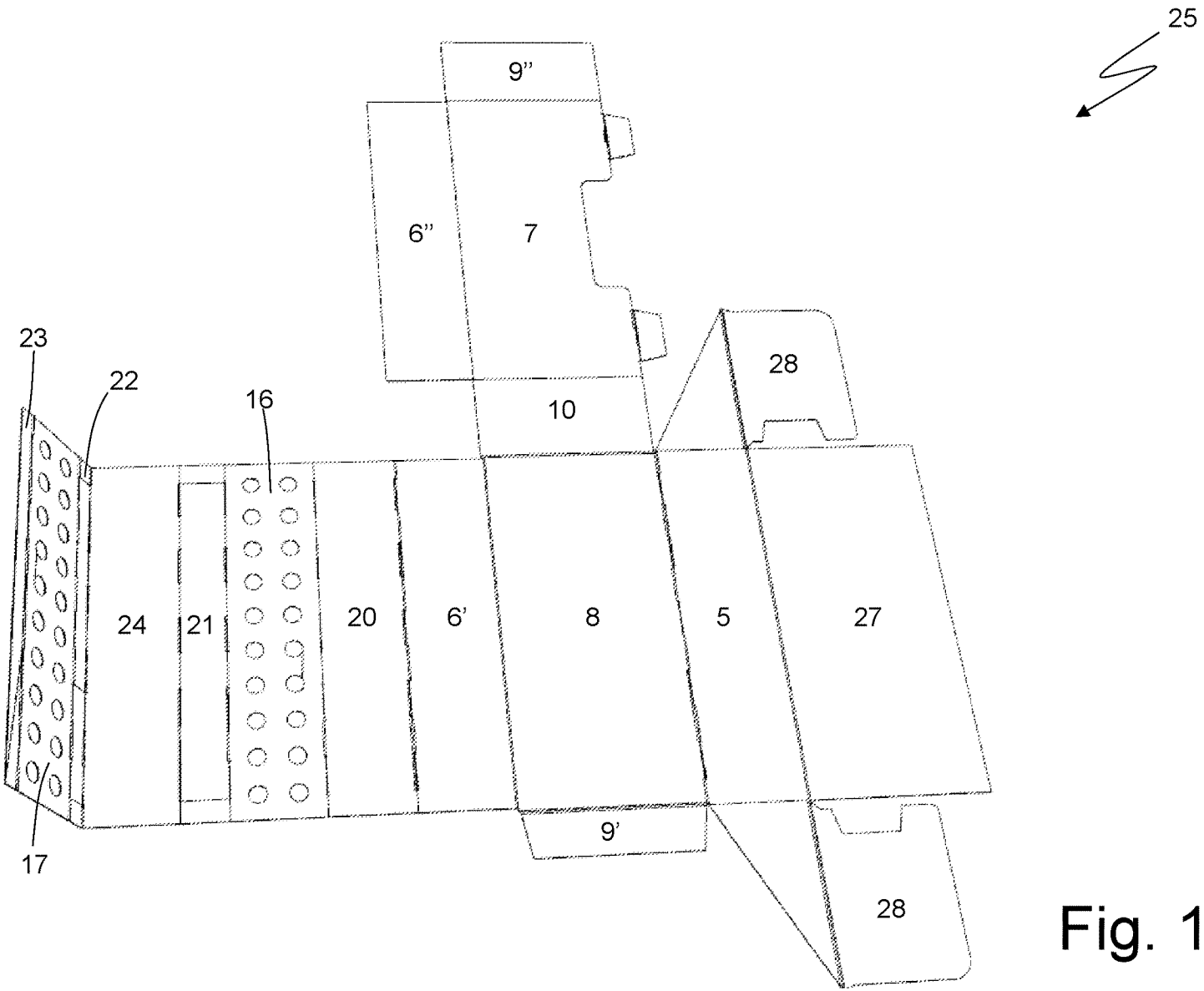
FIGS. 18-29 show a series of perspective views of the blank of FIG. 17 during a succession of wrapping operations to manufacture the pack of FIG. 16.

Initially and as shown in FIG. 18, the support tab 22 is bent by 180° around the corresponding transverse bending line 19 and relative to the connection wall 24 until the containing wall 17 rests partially above the connection wall 24 and partially above the support tab 21 and especially until the support tab 23 rests above the support tab 21. In this step, the support tab 23 is glued to the support tab 21 establishing a permanent and non-separable union with the support tab 21 due to a glue previously applied on the support tab 23 or on the support tab 21.

Figure 19:
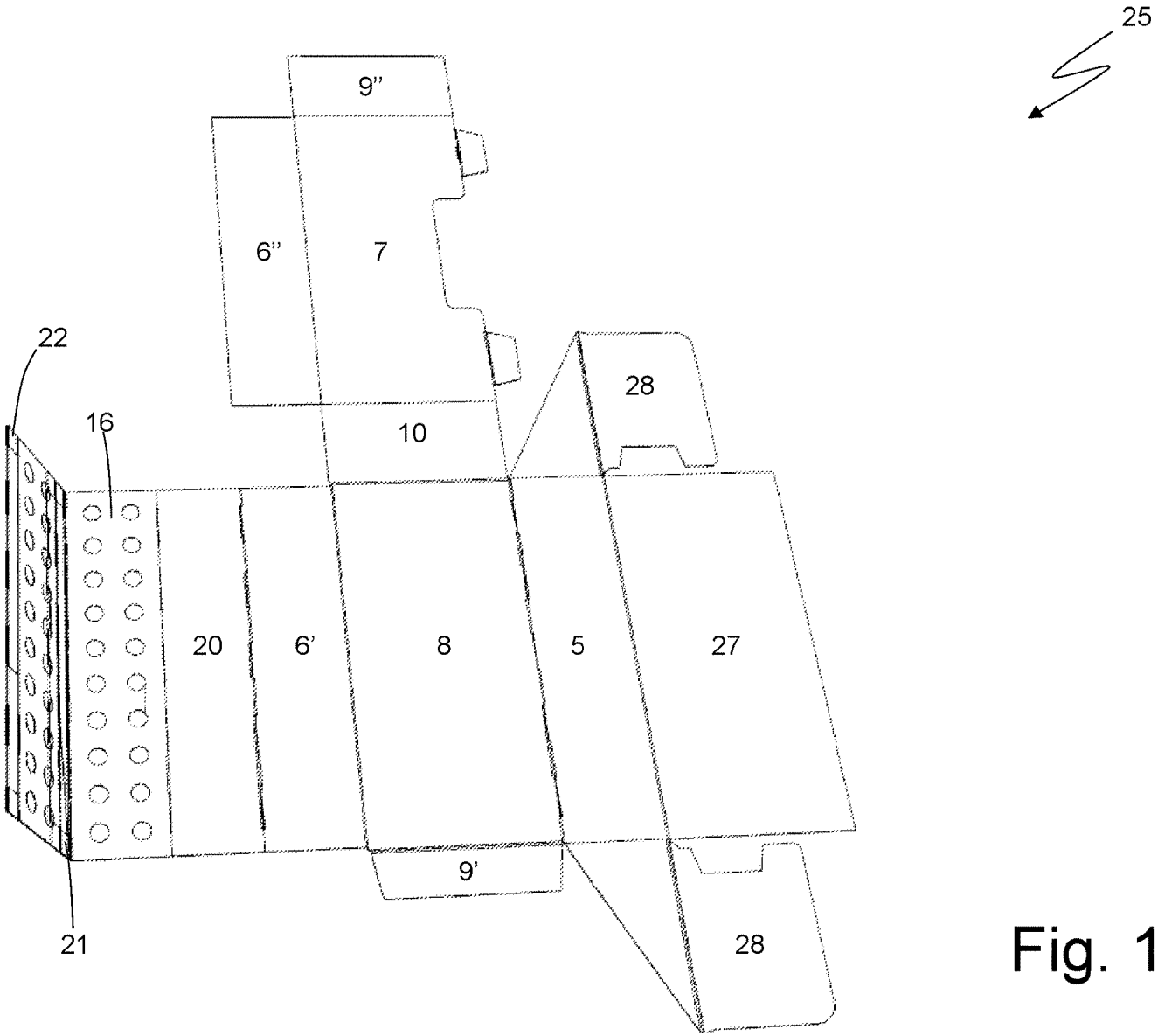

Subsequently and as shown in FIG. 19, the support tab 21 is bent by 180° around the corresponding transverse bending line 19 and relative to the containing wall 16 until the support tab 22 rests above the support tab 20. In this step, the support tab 22 is glued to the support tab 20 establishing a permanent and non-separable union with the support tab 20 due to a glue previously applied on the support tab 22 or on the support tab 20.

Figure 20:
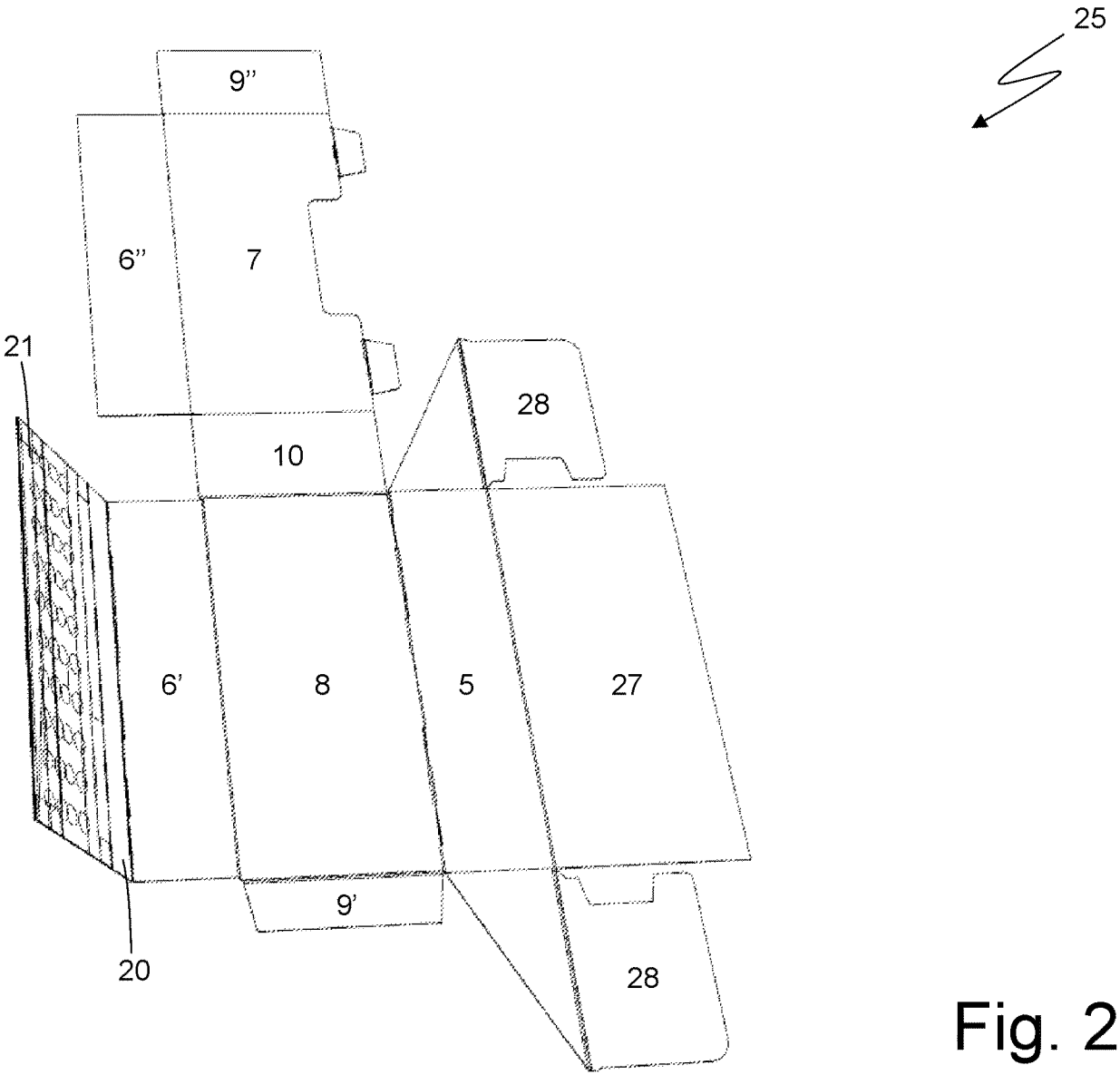

Subsequently and as shown in FIG. 20, the support tab 20 is bent by 180° around the corresponding transverse bending line 19 and relative to the panel 6' until the support tab 21 rests above the rear wall 8. In this step, the support tab 21 is glued to the rear wall 8 establishing a permanent and non-separable union with the rear wall 8 due to a glue previously applied on the support tab 21 or on the rear wall 8.

Figure 21:
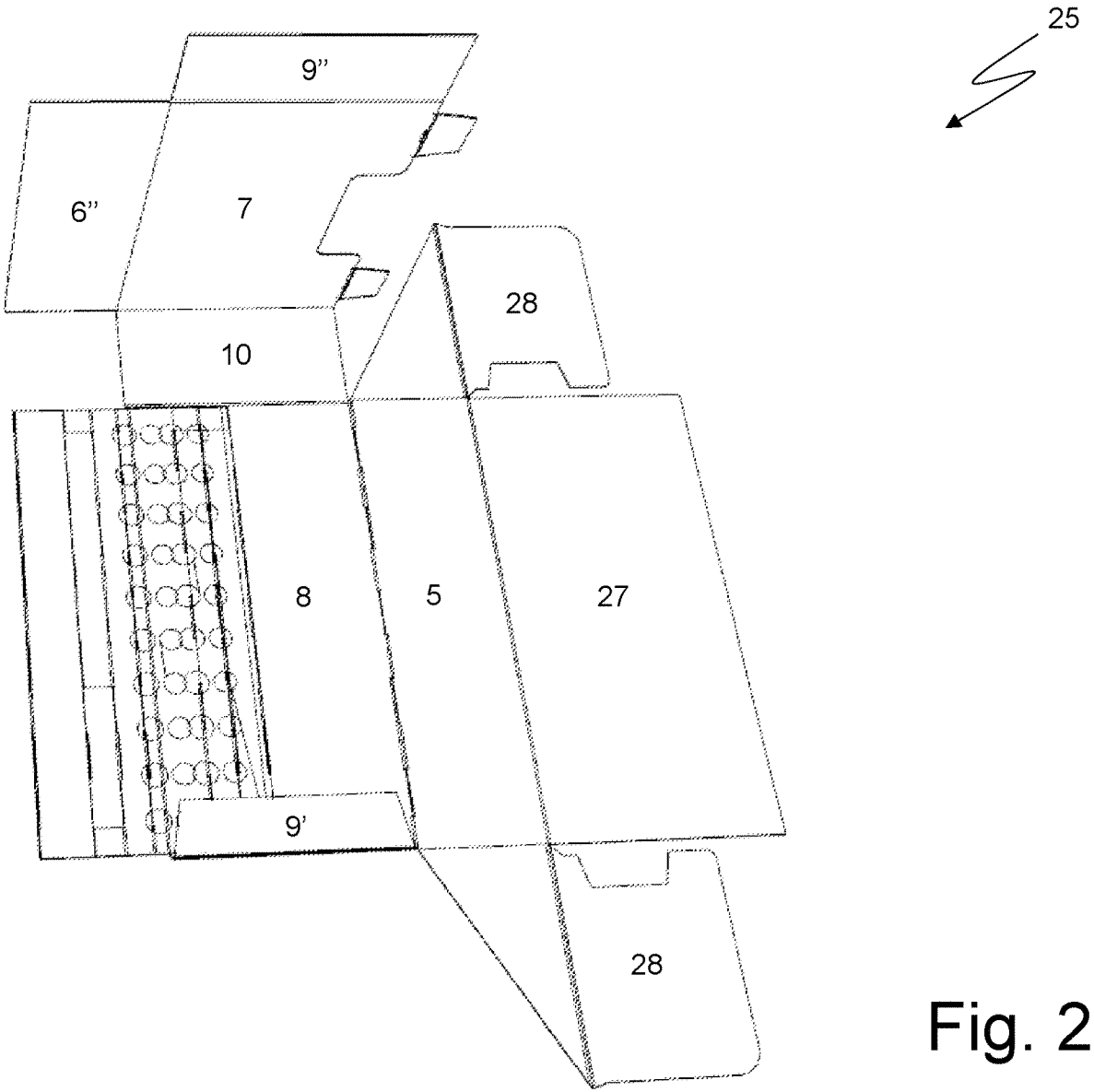

Subsequently and as shown in FIG. 21, the panel 9' is bent by 180° around the corresponding longitudinal bending line 26 and relative to the rear wall 8 in order to rest the panel 9' against the rear wall 8 and subsequently (or simultaneously) the front wall 7 is bent by 180° around the corresponding longitudinal bending line 26 and relative to the side wall 10 in order to overlap the front wall 7 partially on the side wall 9 and partially on the rear wall 8 and especially to overlap the panel 9" on the previously bent panel 9'. In this step, the panel 9' is glued to the panel 9" establishing a permanent and non-separable union with the panel 9" due to a glue previously applied on the panel 9" or on the panel 9'.

At this point, the blank 25 has the appearance shown in FIG. 22 and has a partially bent but still flat shape (i.e. without delimiting a containment volume in its inside); preferably, all the above-described bending and gluing operations are carried out at the premises of the supplier producing the blank 25 and the partially bent blank 25 (as shown in FIG. 22) is fed to a packer machine which, starting from the partially bent blank 25, manufactures the rigid pack 1 in the manner described below.

Figure 23:
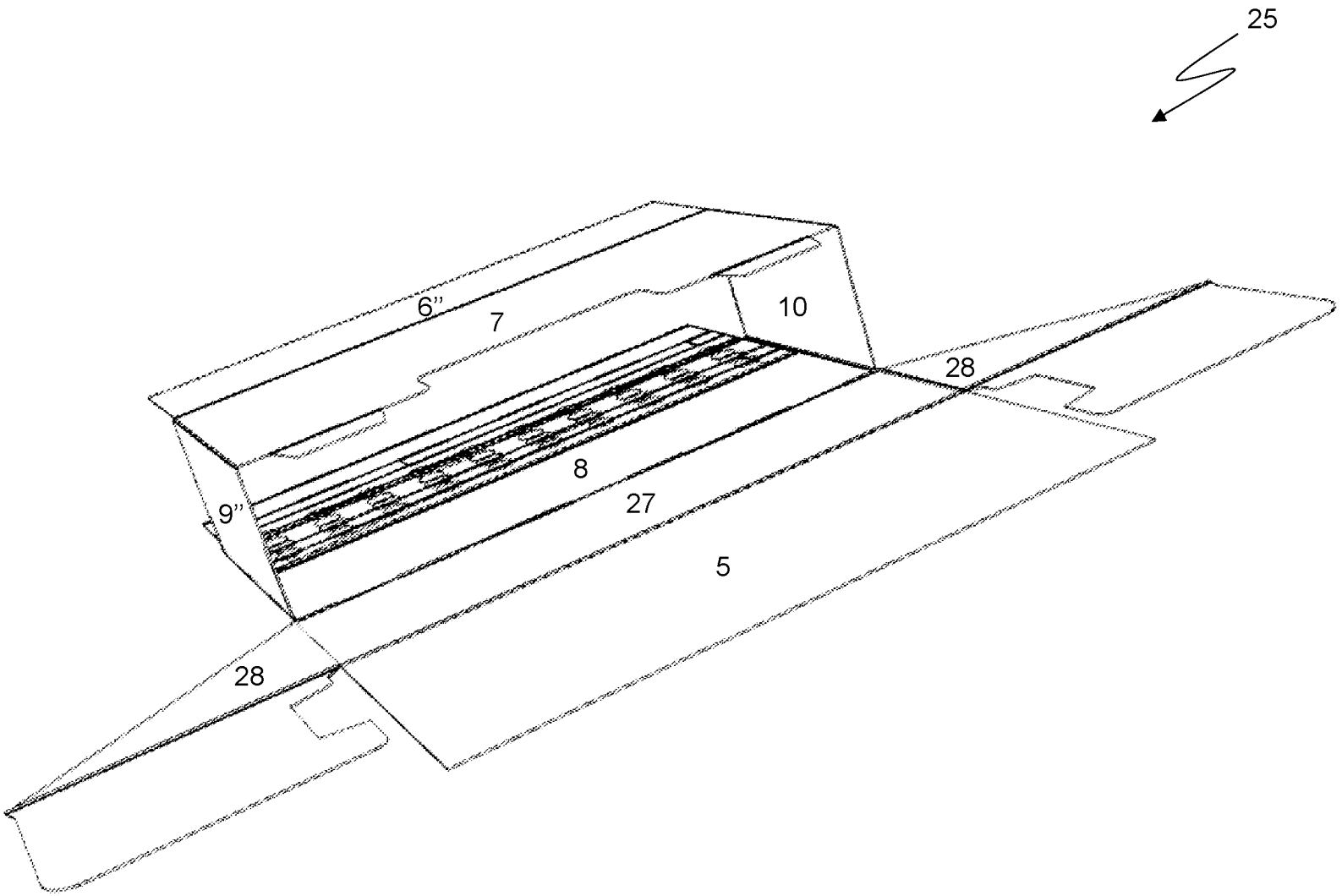

As a first operation and as shown in FIG. 23, the packer machine (normally by pushing on the side wall 10) bends by 90° both side walls 9 and 10 of the container 2 relative to the rear wall 8 of the container 2 an equivalent and simultaneous bending of both side walls 9 and 10 of the container 2 also relative to the front wall 7 of the container 2.

Figure 24:
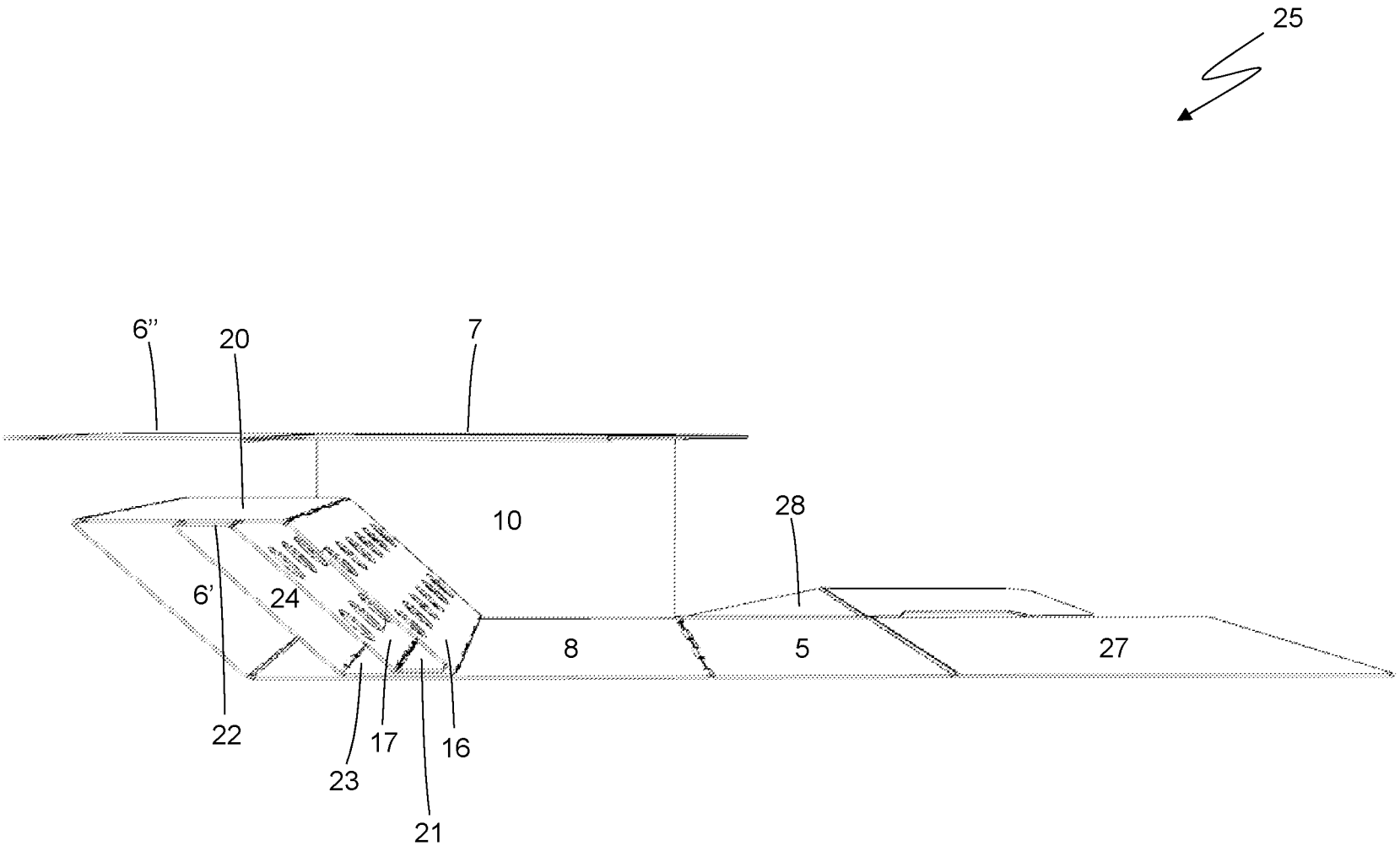
Figure 25:
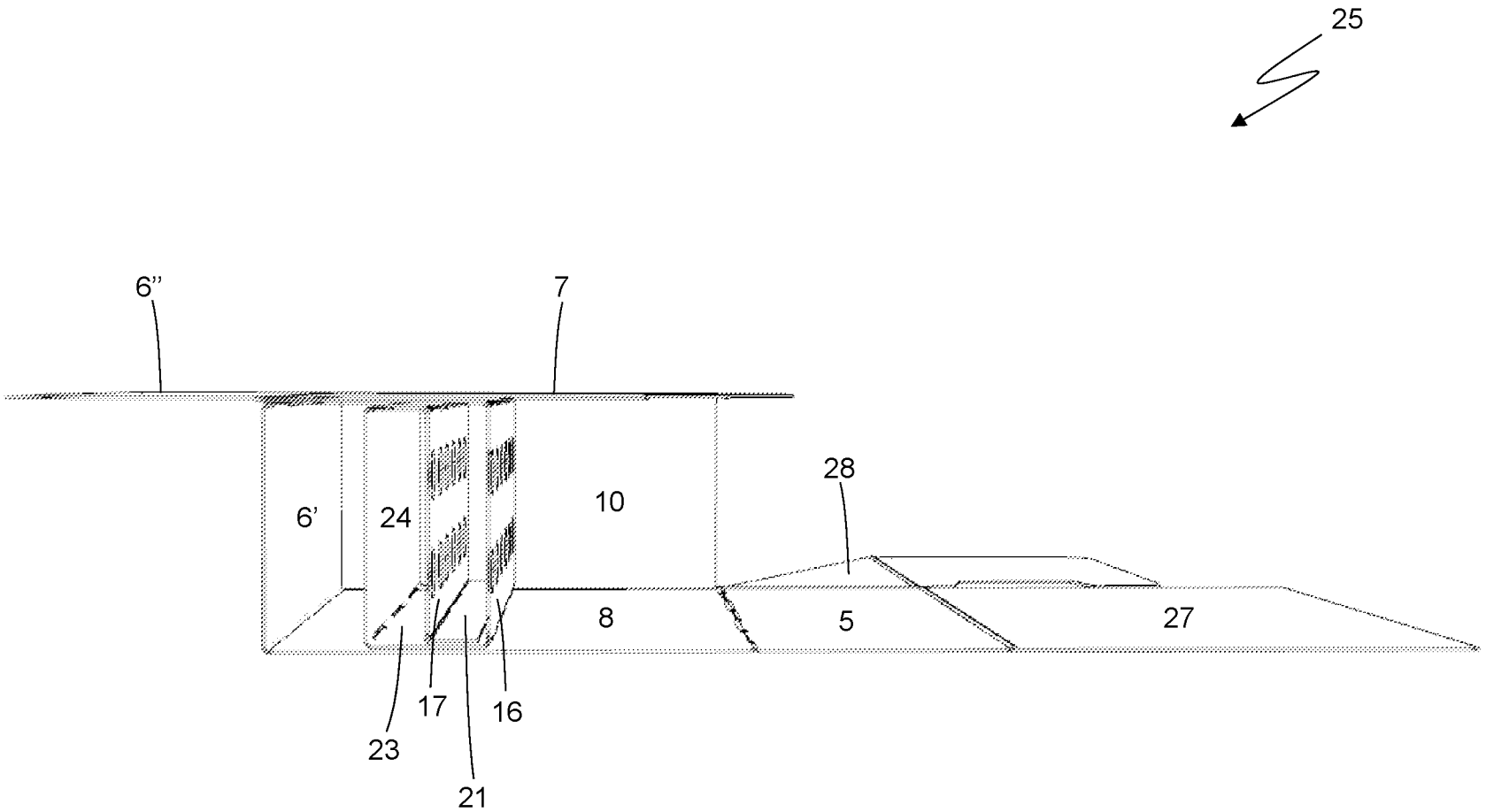

Subsequently and as shown in FIGS. 24 and 25 (in longitudinal section), the packer machine (normally by pushing on the panel 6') bends the panel 6' by 90° around the corresponding transverse bending line 19 and relative to the rear wall 8 consequently the lifting of the entire support system 15, i.e.: the 90° bending of the connection wall 24 around the corresponding transverse bending line 19 and relative to the support tab 21, the 90° bending of the containing wall 17 around the corresponding transverse bending line 19 and relative to the support tab 23, and the 90° bending of the containing wall 16 around the corresponding transverse bending line 19 and relative to the support tab 21. In other words, the thrust that is exerted on the panel 6' and which leads to the 90° bending of the panel 6' is also transmitted through the support tab 20 to the walls 16, 17 and 24, which are also bent by 90° in a synchronised manner with the panel 6'.

Figure 26:
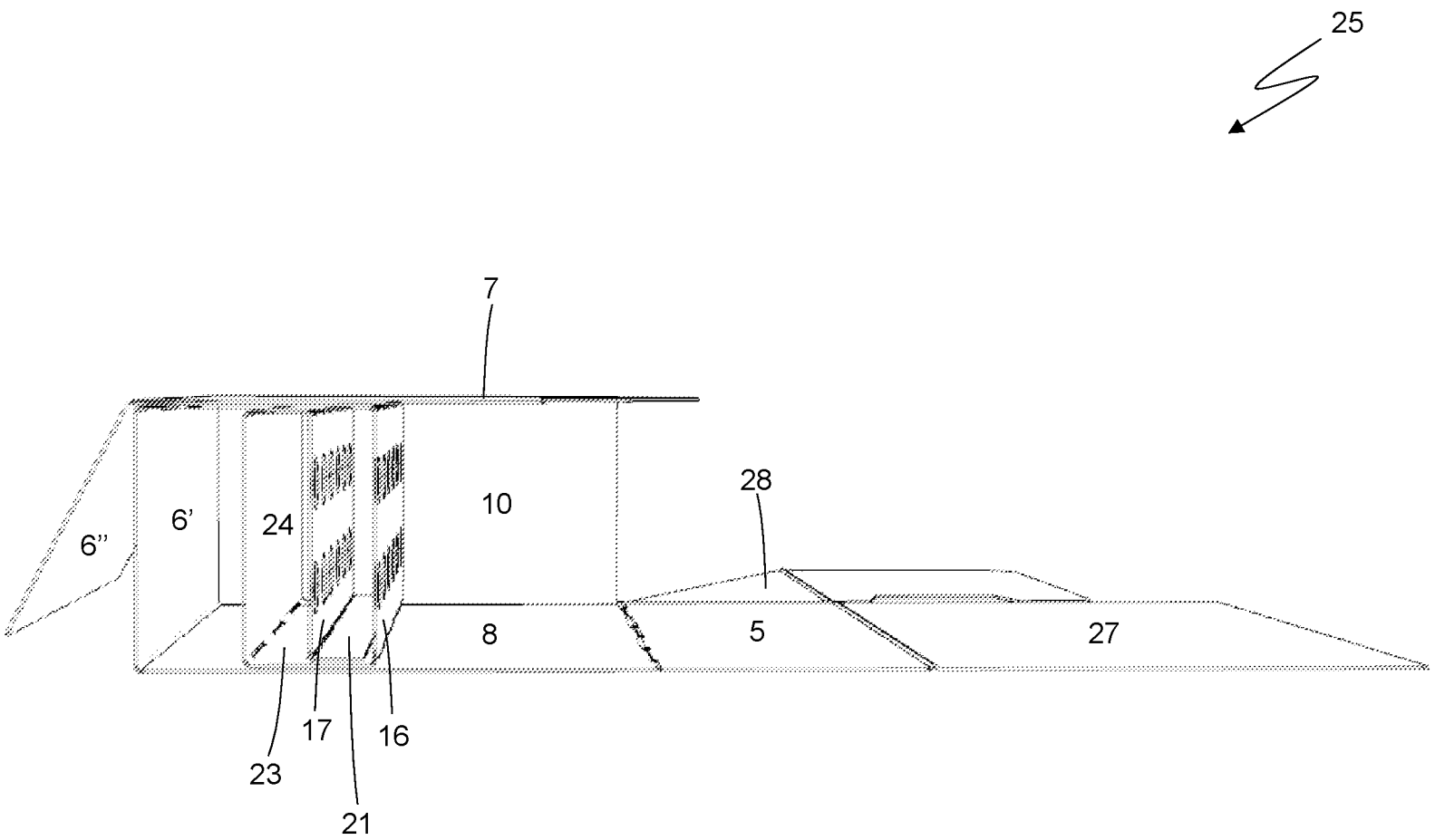

Subsequently and as shown in FIG. 26 (in longitudinal section), the packer machine (pushing on the panel 6") bends the panel 6" by 90° around the corresponding transverse bending line 19 and relative to the front wall 7 of the container 2 until the panel 6" overlaps the panel 6'. In this step, the panel 6' is glued to the panel 6" establishing a permanent and non-separable union with the panel 6" due to a glue previously applied on the panel 6" or on the panel 6'; the permanent union between the two panels 6' and 6" stabilises (i.e. "freezes") the conformation of the support system 15 which loses all freedom of movement.

Figure 27:
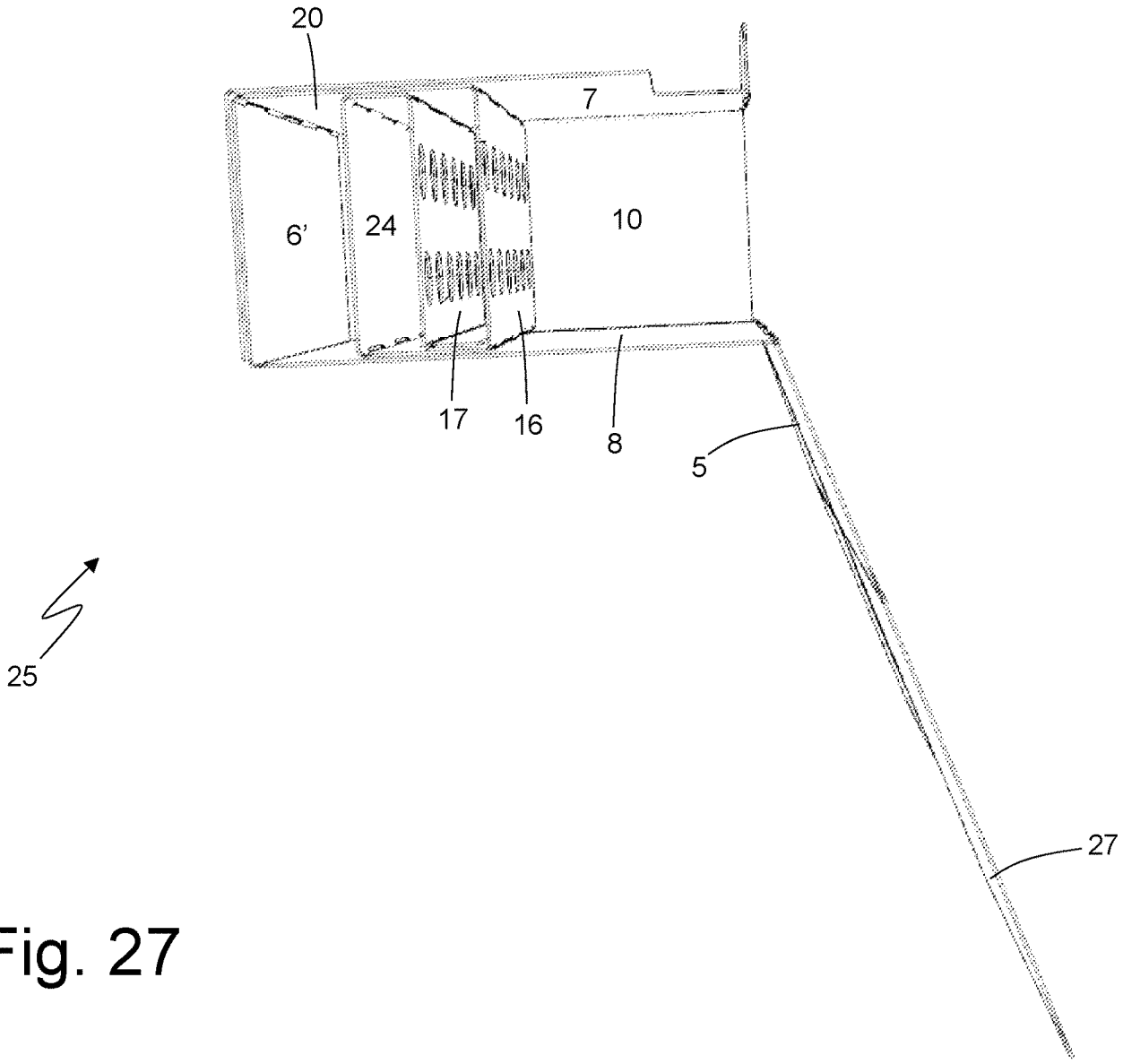

Subsequently and as shown in FIG. 27 (in longitudinal section), the packer machine bends the upper wall 5 in order to move the upper wall 5 away from the opening upper end of the container 2 so as to facilitate the entry of the smoking articles 14; this step is obviously optional, but is preferably performed in order to have a "free field" for the introduction of the smoking articles 14 into the container 2.

Figure 28:
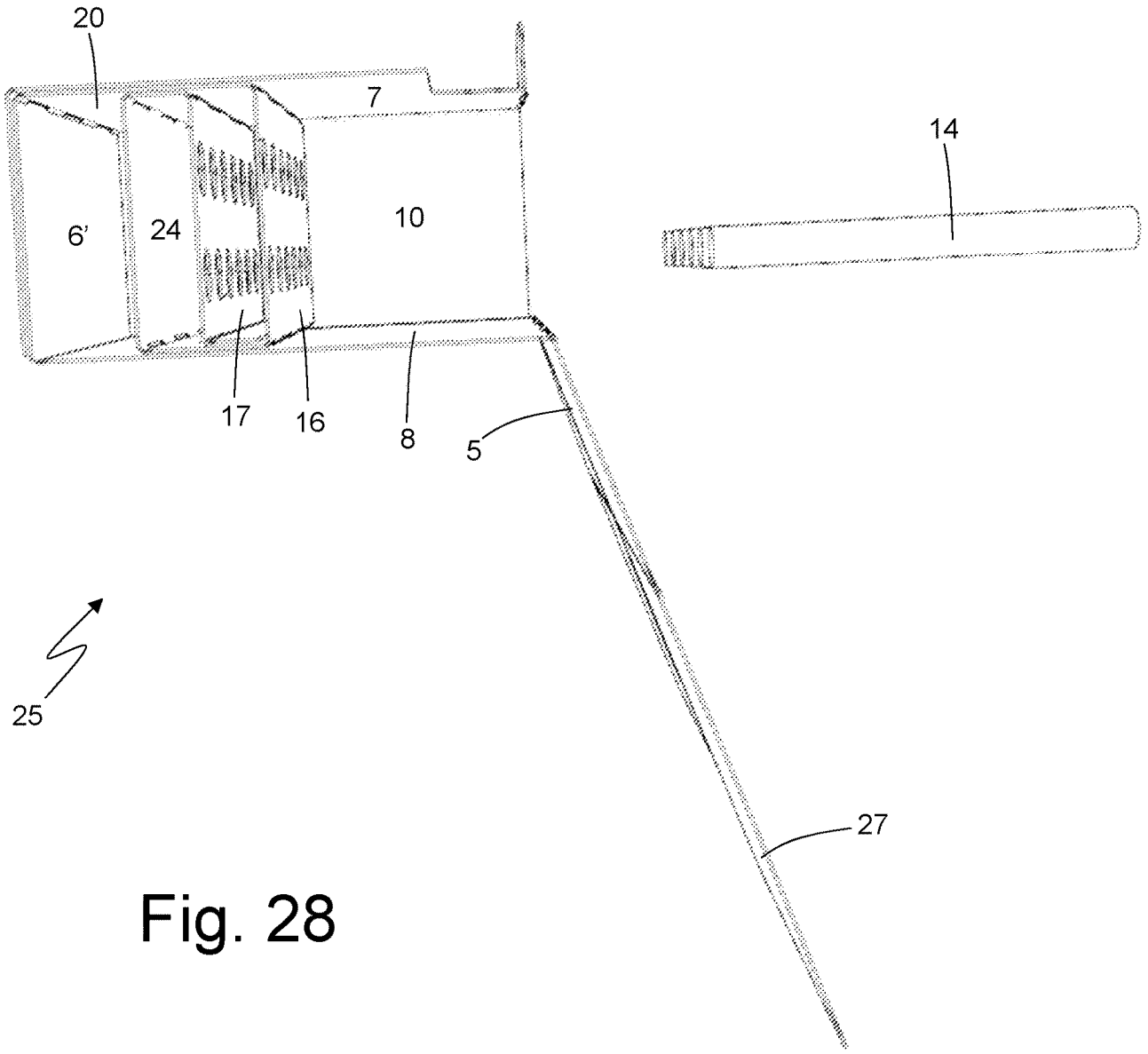
Figure 29:
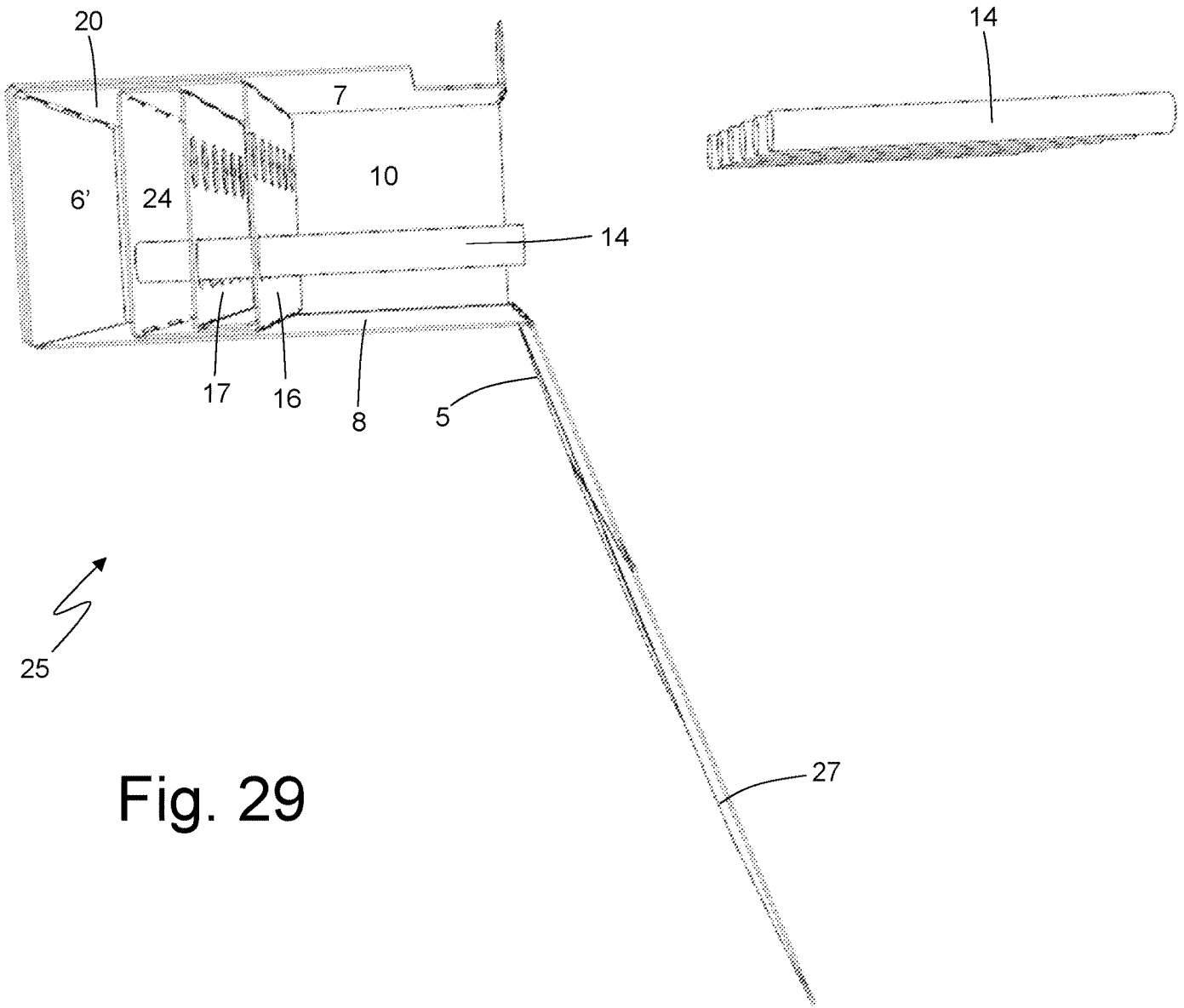

Subsequently and as shown in FIGS. 28 and 29 (in longitudinal section), the smoking articles 14 are inserted into the container 2 by feeding one layer of smoking articles 14 at a time so that each smoking article 14 is arranged in a corresponding seat of the support system 15, i.e. each smoking article 14 enters two respective holes 18 of the two containing walls 16 and 17.

Finally, once the smoking articles 14 have been introduced into container 2, the bending of the container 2 and of the lid 3 is completed in a known manner.

From what has been described above, it is evident that the support system 15 consists of a first articulated parallelogram comprising a frame (the support tab 21) which is glued to the rear wall 8 of the container 2, four cranks (the panel 6", the connection wall 24, and the two support walls 16 and 17), and a connecting rod (the support tab 20) which only rests against the front wall 7 of the container 2; so that, while the rigid pack 1 is being manufactured, the support system 15 can be formed with the first articulated parallelogram in a flat condition and can subsequently be expanded by opening the first articulated parallelogram by means of a rotation of both cranks.

In addition, the rear wall 8 of the container 2, the front wall 7 of the container 2, and the two side walls 9 and 10 of the container 2 constitute a second articulated parallelogram so that, while the rigid pack 1 is being manufactured, the second articulated parallelogram can be formed in a flat condition and can subsequently be expanded by opening the second articulated parallelogram by means of a rotation of both side walls 9 and 10 of the container 2 constituting the cranks of the second articulated parallelogram (instead, the rear wall 8 of the container 2 constitutes the frame of the second articulated parallelogram and the front wall 7 of the container 2 constitutes the connecting rod of the second articulated parallelogram).

Therefore, the manufacture of the rigid pack 1 envisages, at the premises of the supplier manufacturing the blank 15, forming the support system 15 with the first articulated parallelogram in a flat condition and forming the second articulated parallelogram in a flat condition; subsequently, the packer machine (which receives the blanks 25 with the articulated parallelograms already formed and in a flat condition) expands (i.e. "unwinds") the second articulated parallelogram, subsequently it expands (i.e. "unwinds") the first articulated parallelogram inside the second articulated parallelogram previously expanded, joins to one another the two articulated parallelograms by overlapping and gluing together the panel 6' and the panel 6" (in this way, it blocks the expanded position of the two articulated parallelograms, preventing a subsequent deformation thereof), inserts the smoking articles 14 into the container 2 just formed, and then it finally closes the container 2 by bending the parts constituting the lid 3.

According to a different embodiment not shown, the frame of the first articulated parallelogram consists of the support tab 20 which is glued (directly or indirectly) to the front wall 7 of the container 2 while the connecting rod of the first articulated parallelogram consists of the support tab 21 which only rests against the rear wall 8 of the container 2.

In the case of the rigid pack 1 shown in FIGS. 1-6 and 8 and thus provided with the collar 11, the collar 11 is preliminarily bent and glued against the side wall 10 of the container 2, against the front wall 7 of the container 2, and against the panel 9" of the container 2; in other words, the side wall 13 of the collar 11 is preliminarily bent by 180°, around the corresponding longitudinal bending line 26 and relative to the panel 9" so as to overlap and glue the side wall 13 of the collar 11 to the panel 9" of the container 2, to overlap and glue the front wall 12 of the collar 11 to the front wall 7 of the container 2, and to overlap and glue the other side wall 13 of the collar 11 to the side wall 10 of the container 2. Having performed these preliminary operations on the collar 11, the bending of the blanks 25 shown in FIGS. 7 and 9 is entirely analogous to the bending of the blanks 25 shown in FIGS. 11, 13, 15 and 17.

According to a preferred embodiment, the holes 18 of the containing walls 16 and 17 may have an edge that is smaller than a smoking article 14 (i.e. that has a smaller inner diameter than an outer diameter of a smoking article 14) and can be deformed so as to hold, through interference, a corresponding smoking article 14; in this way, when a smoking article 14 enters a hole 18 it must deform (more or less elastically) the edge of the hole 18 and two important results are obtained: the hole 18 is self-centring (i.e. even if the smoking article 14 is not perfectly centred, coaxial, to the hole 18, the edge of the hole 18 tends to centre the smoking article 14 by bringing it into the desired centred position), and the hole 18 holds with a certain (elastic) force the smoking article 14 further stabilising the position of the smoking article 14.

Generally, the edge of a hole 18 is made deformable (more or less elastically) by making cuts (at least three, but generally not less than four), which are oriented more or less radially and originate from the edge of the hole 18.

Figure 30:
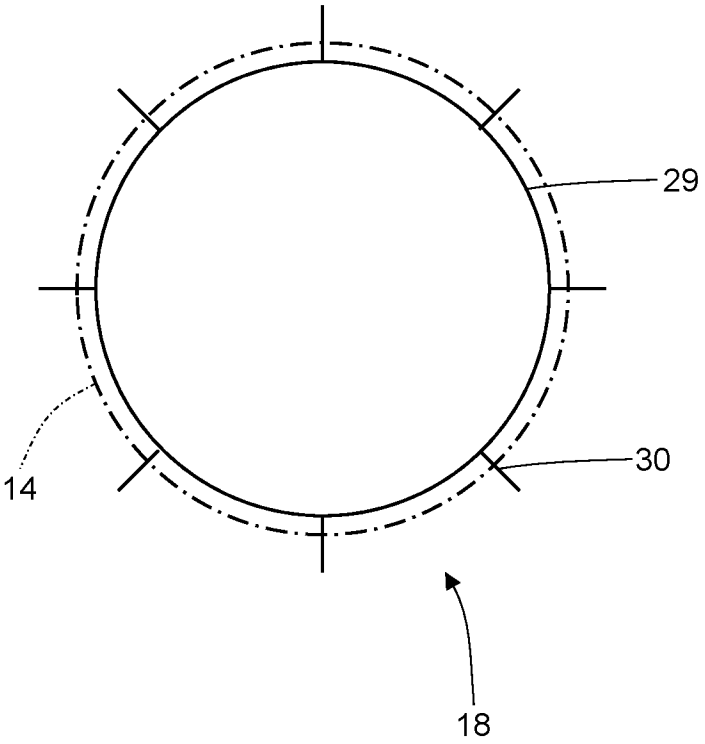

In the embodiment shown in FIG. 30, each hole 18 consists of a circular through incision 29 (which creates an actual hole with no material on its inside) having a smaller inner diameter than an outer diameter of a smoking article 14 and a series of cuts 30 which are oriented radially and originate from the incision 29.

Figure 31:
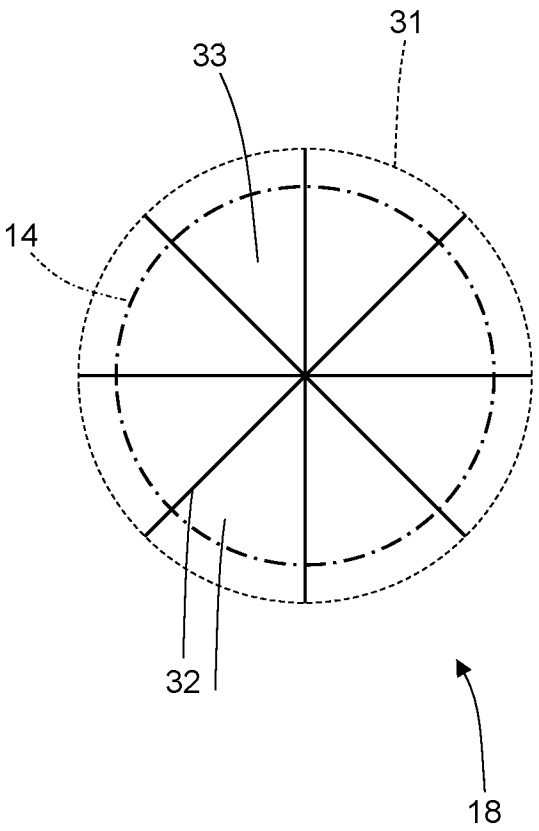
FIGS. 30-33 schematically show some possible configurations of through holes of containing walls of a pack support system of FIG. 1.

In the embodiment shown in FIG. 31, each hole 18 comprises a series of cuts 31 originating from an outer (virtual) circular ring 32 and joining at the centre of the ring 32 in order to define a plurality of flexible flaps 33; according to one possible embodiment, the ring 32 is pre-weakened to increase the flexibility of the flaps 33. In addition, the ring 32 has a greater diameter than an outer diameter of a smoking article 14.

Figure 33:
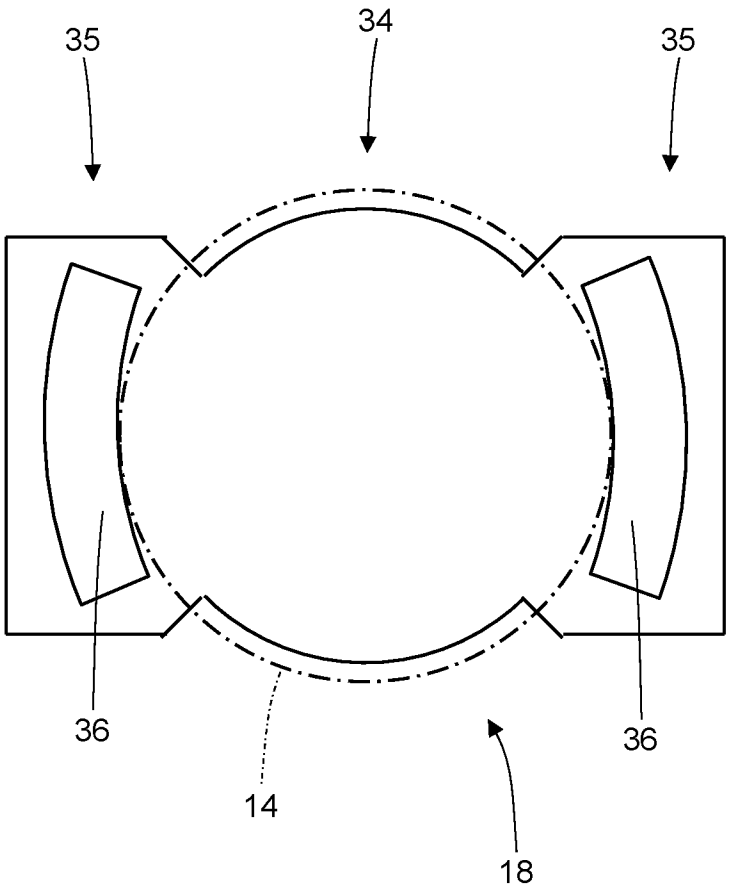
Figure 32:
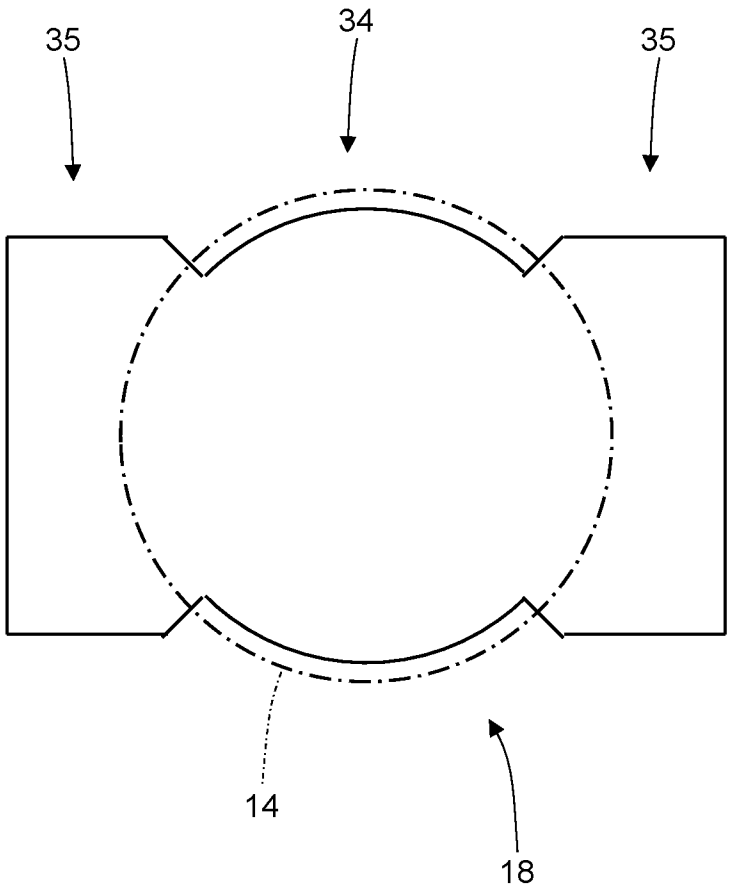

In the embodiments shown in FIGS. 30 and 31, the holes 18 have a circular shape, i.e. a perfectly circular symmetry around a centre. On the other hand, in the embodiment shown in FIGS. 32 and 33, the holes 18 have a central part 34 with a circular shape which is suited to hold, through interference, a corresponding smoking article 14 and two side appendages 35 which are not suited to hold a corresponding smoking article 14 but are suited to allow for the passage of two accompanying elements 36 (shown in FIG. 33) which accompany the insertion movement of the corresponding smoking article 14 into the hole 18. That is, when a smoking article 14 is inserted into the container 2 it is followed by two accompanying elements 36 which are arranged at opposite ends of the smoking article 14 and clamp between them (accompany) the smoking article 14; only when the smoking article 14 has correctly got into both corresponding holes 18 of the containing walls 16 and 17, the two accompanying elements 36 release the smoking article 14 (e.g. by opening slightly one relative to the other in order to move away from the smoking article 14) and then get out of the container 2 leaving the smoking article 14 in position.

According to a different embodiment, the support system 15 comprises a single containing wall 16 or the support system 15 comprises three or more containing walls 16 and 17.

The embodiment shown in the accompanying figures relates to the manufacture of a rigid pack 1 for rod-shaped smoking articles, but the present invention is also applicable without substantial modifications to the manufacture of any other type of rigid pack of rod-shaped smoking articles.

The herein described embodiments can combine one another without departing from the scope of protection of the present invention.

The above described pack 1 has several advantages.

Firstly, the rigid pack 1 described above requires the use of a single blank 25 to manufacture all components (i.e. the container 2, the collar 11, and the support system 15) and this allows the rigid pack 1 to be manufactured using a single wrapping unit. Consequently, the rigid pack 1 described above is simple and inexpensive to produce.

In addition, the rigid pack 1 described above provides a protected and secure housing for smoking articles 14 while allowing a very easy picking of the smoking articles 14 thanks to the distance that is maintained inside the container 2 between a smoking article 14 and the adjacent smoking articles 14.

The invention claimed is:

1. A pack for rod-shaped articles; the pack comprises:

a group of articles;

a parallelepiped-shaped container, which houses the group of articles and has at least a lower wall, a front wall, a rear wall and two side walls; and a support system, which is arranged in the container and having at least a first containing wall, which is parallel to the lower wall and is provided with a plurality of through holes, each engaged by a corresponding rod-shaped article;

wherein the support system comprises a first articulated parallelogram comprising a frame, which is glued to the rear wall or to the front wall of the container, at least two cranks and a connecting rod, which only rests against the front wall or the rear wall of the container, so that, while the rigid pack is being manufactured, the support system can be formed with the first articulated parallelogram in a flat condition and can subsequently be expanded by opening the first articulated parallelogram by means of a rotation of the at least two cranks;

wherein the support system comprises the first containing wall, which constitutes a crank of the first articulated parallelogram, and a first panel, which constitutes another crank of the first articulated parallelogram and is part of the lower wall of the container;

wherein the lower wall of the container consists of the first panel arranged on the inside and of a second panel, which is arranged on the outside, overlaps and is glued to the first panel and is hinged to the rear wall of the container.

2. The pack according to claim 1, wherein the support system comprises a first support tab, which is part of the first articulated parallelogram, is hinged—at an end— to the first panel, is hinged—at the opposite end— to the first containing wall, is bent by 90° relative to the first panel and is bent by 90° relative to the first containing wall.

3. The pack according to claim 2, wherein the support system comprises a second containing wall, which is parallel to and spaced apart from the first containing wall, is provided with a plurality of through holes, each engaged by a corresponding rod-shaped article, and constitutes a crank of the first articulated parallelogram.

4. The pack according to claim 3, wherein the support system comprises a second support tab, which is connected to an end of the second containing wall and is bent by 90° relative to the second containing wall, and a third support tab, which is connected to an opposite end of the second containing wall and is bent by 90° relative to the second containing wall.

5. The pack according to claim 3, wherein the support system comprises a connection wall, which is parallel to and spaced apart from the second containing wall and constitutes a crank of the first articulated parallelogram.

6. The pack according to claim 5, wherein the support system comprises a second support tab, which constitutes the frame of the first articulated parallelogram, is glued to the rear wall or to the front wall of the container, is hinged—at an end— to the first containing wall, is hinged—at the opposite end— to the connection wall, is bent by 90° relative to the first containing wall and is bent by 90° relative to the connection wall.

7. The pack according to claim 1, wherein:

a second articulated parallelogram is constituted by the rear wall of the container, the front wall of the container and the two side walls of the container defining cranks of the second articulated parallelogram;

while the rigid pack is being manufactured, the second articulated parallelogram can be formed in a flat condition and can subsequently be expanded by opening the second articulated parallelogram by means of a rotation of both side walls of the container.

8. The pack according to claim 1, wherein each hole of the first containing wall has an edge, which has a smaller inner diameter than an outer diameter of an article and can be deformed so as to hold, through interference, a corresponding article.

9. The pack according to claim 8, wherein each hole consists of a circular through incision having a smaller inner diameter than an outer diameter of an article and of a series of cuts, which are oriented radially and originate from the incision.

10. The pack according to claim 8, wherein each hole consists of a series of cuts, which originate from a circular outer ring, which is pre-weakened and has a greater diameter than an outer diameter of an article, and join one another at the center of the ring in order to define a plurality of flexible flaps.

11. The pack according to claim 1, wherein each hole comprises a central part with a circular shape, which is suited to hold, through interference, a corresponding article, and two side appendages, which are not suited to hold a corresponding article, but are suited to allow for the passage of two accompanying elements, which accompany the insertion movement of the corresponding article into the hole.

12. A manufacturing method to manufacture a pack according to claim 1 and comprising the steps of:

forming, in a blank, the support system with the first articulated parallelogram in a flat condition;

expanding the support system by opening the first articulated parallelogram by means of a rotation of the at least two cranks; and inserting the articles into the holes of the first containing wall.

13. The manufacturing method according to claim 12, wherein:

the rear wall of the container, the front wall of the container and the two side walls of the container constitute a second articulated parallelogram;

there is provided the further step of forming the second articulated parallelogram; and there is provided the further step of expanding the second articulated parallelogram by means of a rotation of both side walls of the container constituting the cranks of the second articulated parallelogram.

14. The manufacturing method according to claim 13, wherein the second articulated parallelogram is expanded before expanding the first articulated parallelogram and the first articulated parallelogram is expanded inside the second articulated parallelogram, which was previously expanded.

15. The manufacturing method according to claim 13, wherein, after having been expanded, the two articulated parallelograms are joined to one another by overlapping and gluing a first panel, which constitutes a crank of the first articulated parallelogram and is part of the lower wall of the container, and a second panel, which is connected to the rear wall of the container and is also part of the lower wall of the container.

16. The manufacturing method according to claim 1, wherein the blank having the first articulated parallelogram in a flat condition is formed beforehand and upstream of a packer machine and is subsequently fed to the packer machine, which expands the support system by opening the first articulated parallelogram and subsequently inserts the articles into the holes of the first containing wall.

17. The manufacturing method according to claim 1, wherein:

each hole has a central part with a circular shape, which is suited to hold, through interference, a corresponding article, and two side appendages, which are not suited to hold a corresponding article;

when an article is inserted into the container, it is followed by two accompanying elements, which are arranged at the two opposite ends of the article, clamp between them the article and get into the side appendages of the corresponding hole; and when the article is correctly inserted in the corresponding hole of the first containing wall, the two accompanying elements release the article and then get out of the container leaving the article in position.

18. A blank to manufacture a rigid pack according to claim 1 and comprising:

the lower wall of the container;

the front wall of the container;

the rear wall of the container;

the two side walls of the container; and the support system consisting of the first articulated parallelogram in a flat condition.

19. A pack for rod-shaped articles; the pack comprises:

a group of articles;

a parallelepiped-shaped container, which houses the group of articles and has at least a lower wall, a front wall, a rear wall and two side walls; and a support system, which is arranged in the container and having at least a first containing wall, which is parallel to the lower wall and is provided with a plurality of through holes, each engaged by a corresponding rod-shaped article;

wherein the support system comprises a first articulated parallelogram comprising a frame, which is glued to the rear wall or to the front wall of the container, at least two cranks and a connecting rod, which only rests against the front wall or the rear wall of the container, so that, while the rigid pack is being manufactured, the support system can be formed with the first articulated parallelogram in a flat condition and can subsequently be expanded by opening the first articulated parallelogram by means of a rotation of the at least two cranks;

wherein each hole comprises a central part with a circular shape, which is suited to hold, through interference, a corresponding article, and two side appendages, which are not suited to hold a corresponding article, but are suited to allow for the passage of two accompanying elements, which accompany the insertion movement of the corresponding article into the hole.

20. A manufacturing method to manufacture a pack for rod-shaped articles; the pack comprises:

a group of articles;

a parallelepiped-shaped container, which houses the group of articles and has at least a lower wall, a front wall, a rear wall and two side walls; and a support system, which is arranged in the container and having at least a first containing wall, which is parallel to the lower wall and is provided with a plurality of through holes, each engaged by a corresponding rod-shaped article;

wherein the support system comprises a first articulated parallelogram comprising a frame, which is glued to the rear wall or to the front wall of the container, at least two cranks and a connecting rod, which only rests against the front wall or the rear wall of the container, so that, while the rigid pack is being manufactured, the support system can be formed with the first articulated parallelogram in a flat condition and can subsequently be expanded by opening the first articulated parallelogram by means of a rotation of the at least two cranks;

wherein the rear wall of the container, the front wall of the container and the two side walls of the container constitute a second articulated parallelogram;

wherein the manufacturing method comprises the steps of: forming, in a blank, the support system with the first articulated parallelogram in a flat condition; expanding the support system by opening the first articulated parallelogram by means of a rotation of the at least two cranks; inserting the articles into the holes of the first containing wall; forming the second articulated parallelogram; expanding the second articulated parallelogram by means of a rotation of both side walls of the container constituting the cranks of the second articulated parallelogram;

wherein the second articulated parallelogram is expanded before expanding the first articulated parallelogram and the first articulated parallelogram is expanded inside the second articulated parallelogram, which was previously expanded.

21. A manufacturing method to manufacture a pack for rod-shaped articles; the pack comprises:

a group of articles;

a parallelepiped-shaped container, which houses the group of articles and has at least a lower wall, a front wall, a rear wall and two side walls; and a support system, which is arranged in the container and having at least a first containing wall, which is parallel to the lower wall and is provided with a plurality of through holes, each engaged by a corresponding rod-shaped article;

wherein the support system comprises a first articulated parallelogram comprising a frame, which is glued to the rear wall or to the front wall of the container, at least two cranks and a connecting rod, which only rests against the front wall or the rear wall of the container, so that, while the rigid pack is being manufactured, the support system can be formed with the first articulated parallelogram in a flat condition and can subsequently be expanded by opening the first articulated parallelogram by means of a rotation of the at least two cranks;

wherein the rear wall of the container, the front wall of the container and the two side walls of the container constitute a second articulated parallelogram;

wherein the manufacturing method comprises the steps of:

forming, in a blank, the support system with the first articulated parallelogram in a flat condition; expanding the support system by opening the first articulated parallelogram by means of a rotation of the at least two cranks; inserting the articles into the holes of the first containing wall; and forming the second articulated parallelogram; expanding the second articulated parallelogram by means of a rotation of both side walls of the container constituting the cranks of the second articulated parallelogram;

wherein, after having been expanded, the two articulated parallelograms are joined to one another by overlapping and gluing a first panel, which constitutes a crank of the first articulated parallelogram and is part of the lower wall of the container, and a second panel, which is connected to the rear wall of the container and is also part of the lower wall of the container.

* * * * *